US010933965B2

(12) United States Patent
Kimball

(10) Patent No.: US 10,933,965 B2
(45) **Date of Patent: *Mar. 2, 2021**

(54) METHOD OF INSTALLING JET PUMP

(71) Applicant: Indmar Products Company Inc., Millington, TN (US)

(72) Inventor: Kevin J. Kimball, Mount Dora, FL (US)

(73) Assignee: Indmar Products Company Inc., Millington, TN (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/656,004

(22) Filed: Oct. 17, 2019

(65) Prior Publication Data

US 2020/0062364 A1 Feb. 27, 2020

Related U.S. Application Data

(63) Continuation of application No. 16/106,480, filed on Aug. 21, 2018, now Pat. No. 10,486,786.

(51) Int. Cl.

| | |
|---|---|
| ***B63H 11/00*** | (2006.01) |
| ***B63H 21/32*** | (2006.01) |
| ***B63H 11/11*** | (2006.01) |
| ***B63H 11/04*** | (2006.01) |
| *B63H 21/00* | (2006.01) |

(52) U.S. Cl.

CPC ..... *B63H 21/32* (2013.01); *B63H 11/04* (2013.01); *B63H 11/11* (2013.01); *B63H 21/24* (2013.01)

(58) Field of Classification Search

CPC ..... B63H 21/32; B63H 21/24; B63H 21/30; B63H 2021/32; B63H 2021/307; B63H 11/04; B63H 11/10; B63H 11/107; B63H 11/11; B63H 2011/004

USPC ..... 440/38, 40, 41, 52, 89 R

See application file for complete search history.

(56) References Cited

U.S. PATENT DOCUMENTS

| | | | |
|---|---|---|---|
| 5,460,552 | A | 10/1995 | Blanchard et al. |
| 5,460,553 | A | 10/1995 | Craig et al. |
| 5,464,357 | A | 11/1995 | Craig et al. |
| 5,490,804 | A | 2/1996 | Blanchard et al. |
| 5,713,768 | A | 2/1998 | Jones |
| 5,846,105 | A | 12/1998 | Baker et al. |
| 5,964,626 | A | 10/1999 | Varney et al. |
| 6,004,173 | A | 12/1999 | Schott |
| 6,033,272 | A | 3/2000 | Whiteside |
| 6,113,443 | A | 9/2000 | Eichinger |

(Continued)

*Primary Examiner* — Daniel V Venne

(74) *Attorney, Agent, or Firm* — Wood Herron & Evans LLP

(57) ABSTRACT

A jet pump includes a propulsion system including an impeller coupled to a rotatable shaft configured to receive torque from an engine and an exhaust system including an exhaust flow path configured to direct exhaust from the engine to an exterior of the watercraft, wherein the exhaust system is integrated with the propulsion system. In another embodiment, a jet pump includes a propulsion system including a water intake configured to take in water from a body of water, the water intake including an intake grate and an intake base, and an exhaust system including an exhaust flow path configured to direct exhaust from the engine to an exterior of the watercraft, wherein the intake base of the water intake is configured to be coupled to an exterior surface of a hull of the watercraft.

18 Claims, 25 Drawing Sheets

(56) References Cited

U.S. PATENT DOCUMENTS

| | | | | |
|---|---|---|---|---|
| 6,132,269 | A | 10/2000 | Belt | |
| 6,146,219 | A | 11/2000 | Blanchard | |
| 6,176,749 | B1 * | 1/2001 | Kato | B63B 34/10 440/38 |
| 6,299,494 | B1 | 10/2001 | Bowers et al. | |
| 6,428,369 | B1 | 8/2002 | Jones | |
| 6,558,211 | B2 * | 5/2003 | Freitag | B63H 11/113 440/42 |
| 6,776,674 | B2 | 8/2004 | Blanchard | |
| 6,899,575 | B1 | 5/2005 | Rothe et al. | |
| 7,841,915 | B2 * | 11/2010 | Bourret | B63H 11/107 440/41 |
| 8,047,884 | B2 | 11/2011 | Nicholson | |
| 8,202,136 | B2 | 6/2012 | Dagenais et al. | |
| 8,425,269 | B2 | 4/2013 | Walkowiak | |
| 8,480,444 | B2 | 7/2013 | Mataya | |
| 8,622,779 | B2 | 1/2014 | Brouillette et al. | |
| 8,932,091 | B2 | 1/2015 | Nicholson | |
| 9,248,895 | B1 | 2/2016 | Gendron et al. | |
| 9,346,522 | B2 * | 5/2016 | Ruosteinen | B63H 21/36 |
| 9,376,189 | B1 | 6/2016 | De Henau et al. | |
| 9,512,910 | B2 * | 12/2016 | Vaughan | F16H 25/2204 |
| 9,908,601 | B2 * | 3/2018 | Vachon | B63H 11/11 |
| 2003/0199212 | A1 | 10/2003 | Lin | |
| 2011/0092113 | A1 | 4/2011 | Mataya | |
| 2011/0092114 | A1 | 4/2011 | Mataya | |

* cited by examiner

METHOD OF INSTALLING JET PUMP

CROSS REFERENCE TO RELATED APPLICATION

This application is a continuation of U.S. patent application Ser. No. 16/106,480 filed Aug. 21, 2018, now U.S. Pat. No. 10,486,786, which is fully incorporated by reference herein.

TECHNICAL FIELD

The present invention relates generally to jet pumps for watercraft, and more particularly, to a jet pump for watercraft having a compact modular "plug and play" configuration for installation on a hull of the watercraft with a substantial portion of the jet pump configured to be positioned external to the hull.

BACKGROUND

Jet pumps for watercraft such as motorboats typically require multiple hours to completely install the jet pump in the hull of the motorboat along with an engine for powering the jet pump and a separate exhaust system for directing exhaust from the engine to an exterior of the motorboat. For example, it may take between approximately 5 and 7 hours for a technician to complete such an installation. In addition, the technician is typically required to drill a large quantity of holes through the hull of the boat to accommodate various components of the jet pump and the exhaust system. In one example, approximately 67 holes and fasteners may be needed. In addition to contributing to the amount of time required to complete installation, each hole through the hull creates an undesirable opportunity for leakages to occur during use of the motorboat.

Leaking and alignment issues are also known to occur at or near the interface between the jet pump and the hull of the motorboat.

Undesirable vibrations are also frequently transferred between the jet pump and the hull of the motorboat, and may result in damage to components and/or cargo of the motorboat, and/or discomfort to passengers of the motorboat.

Moreover, conventional jet pumps are typically configured for use in a single size or class of watercraft, such that a jet pump configured for use in a watercraft of a first size may not be compatible with a watercraft of a second size.

Accordingly, there is a need for a jet pump for use in a watercraft that overcomes these and other deficiencies of conventional jet pumps.

SUMMARY

According to an exemplary embodiment of the invention, a jet pump for a watercraft includes a propulsion system including an impeller coupled to a rotatable shaft configured to receive torque from an engine and an exhaust system including an exhaust flow path configured to direct exhaust from the engine to an exterior of the watercraft, wherein the exhaust system is integrated with the propulsion system. In one embodiment, the exhaust system includes an exhaust conduit at least partially defining the exhaust flow path, and the rotatable shaft extends through the exhaust conduit. At least a portion of the exhaust conduit and the rotatable shaft may be coaxial. In addition, or alternatively, the propulsion system may include a water intake configured to take in water from a body of water. The exhaust conduit may be coupled to the water intake. The exhaust system may include a cooling water flow path parallel to at least a portion of the exhaust flow path. At least a portion of the exhaust flow path may be parallel to the shaft. In addition, or alternatively, at least a portion of the exhaust flow path may be perpendicular to the shaft. In one embodiment, a watercraft includes a hull including a wall and a jet pump hole provided in the wall and the aforementioned jet pump, wherein the rotatable shaft and the exhaust flow path extend through the jet pump hole.

According to another exemplary embodiment of the invention, a jet pump for a watercraft includes a propulsion system including a water intake configured to take in water from a body of water, the water intake including an intake grate and an intake base. The jet pump further comprises an exhaust system including an exhaust flow path configured to direct exhaust from the engine to an exterior of the watercraft. The intake base of the water intake is configured to be coupled to an exterior surface of a hull of the watercraft. In one embodiment, the jet pump may further include at least one vibration isolator configured to be positioned between the intake base of the water intake and the hull of the watercraft when the intake base of the water intake is coupled to the exterior surface of the hull of the watercraft. For example, the at least one vibration isolator may be positioned between the intake base of the water intake and an intake mount configured to be coupled to the exterior surface of the hull of the watercraft. In addition, or alternatively, the intake base of the water intake may be configured to be coupled to the exterior surface of the hull of the watercraft via an intake mount, and at least a portion of the intake mount may be configured to be received by a recess of the exterior surface of the hull of the watercraft.

In one embodiment, the propulsion system may include a reversing bucket and an electro-mechanical actuator operatively coupled to the reversing bucket for moving the reversing bucket between at least an up position and a down position, wherein the electro-mechanical actuator is configured to be positioned external to the hull of the watercraft. In one embodiment, a watercraft includes a hull including an exterior surface and the aforementioned jet pump, wherein the jet pump is coupled to the exterior surface of the hull of the watercraft. In addition, or alternatively, the watercraft may include a hull and the aforementioned jet pump including the reversing bucket, wherein the electro-mechanical actuator is positioned external to the hull.

According to yet another exemplary embodiment of the invention, a method of installing a jet pump onto a hull of a watercraft includes fixedly coupling an intake mount to an external surface of the hull and positioning a jet pump assembly external to the hull. The partially assembled jet pump includes a rotatable shaft for receiving torque from an engine and a first exhaust path portion for directing exhaust away from the engine, such that the rotatable shaft and the first exhaust path portion extend through a single jet pump hole provided in the hull. The method also includes fixedly coupling the jet pump assembly to the intake mount. In one embodiment, the method further includes inserting a cylindrical seal into the jet pump hole prior to positioning the jet pump assembly. In addition, or alternatively, the method may further include positioning an exhaust banjo internal to the hull, the exhaust banjo including a second exhaust path portion, such that the exhaust banjo surrounds at least a portion of the rotatable shaft. In this regard, the method may further include rotating the exhaust banjo relative to an axis of the rotatable shaft. In addition, or alternatively, the method may further include coupling the exhaust banjo to at least one exhaust port of the engine.

Various additional features and advantages of the invention will become more apparent to those of ordinary skill in the art upon review of the following detailed description of the illustrative embodiments taken in conjunction with the accompanying drawings.

BRIEF DESCRIPTION OF THE DRAWINGS

The drawings, which are incorporated in and constitute a part of this specification, illustrate embodiments of the invention and, together with the general description given above and the detailed description given below, explain the embodiments of the invention.

DETAILED DESCRIPTION

Figure 1:
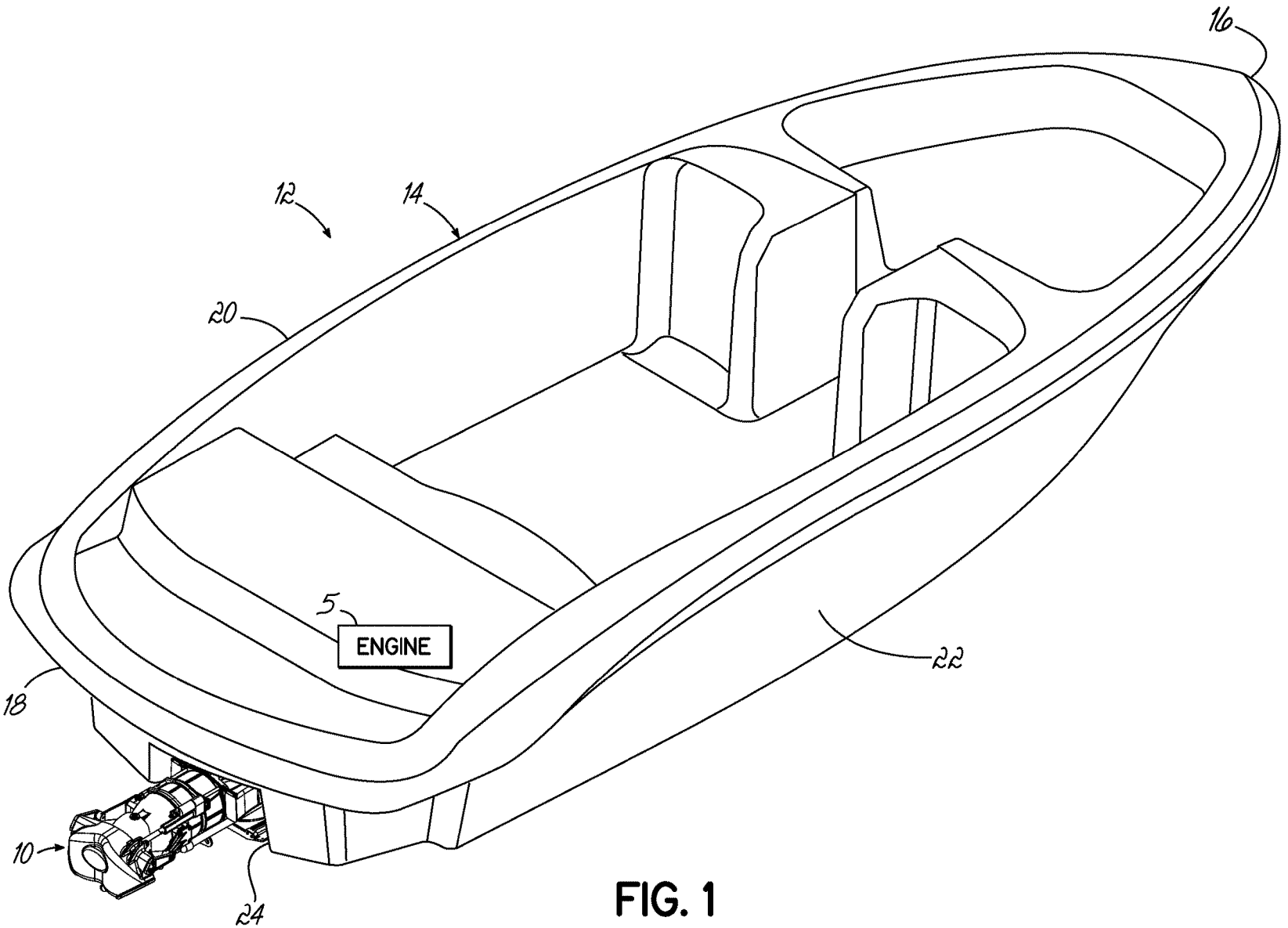
FIG. 1 is a perspective view of a motorboat including an exemplary jet pump in accordance with an aspect of the invention.

Referring now to FIG. 1, an exemplary jet pump 10 according to an aspect of the invention is shown mounted to a motorboat 12. The motorboat 12 includes a hull 14 which has a bow 16, a stern 18, a port side 20, and a starboard side 22, as well as a pump box 24 at or near the stern 18 for accommodating the jet pump 10. The jet pump 10 may be operatively coupled to an engine 5 (shown schematically in FIG. 1) mounted in an "inboard" configuration, for example, for supplying power to the jet pump 10 to propel the motorboat 12 through the water. As discussed in greater detail below, the jet pump 10 may have a compact modular "plug and play" configuration for installation on the hull 14 of the motorboat 12 with a substantial portion of the jet pump 10 positioned external to the hull 14. The features of the jet pump 10 are set forth in further detail below to clarify each of these functional advantages and other benefits provided in this disclosure.

Figure 2:
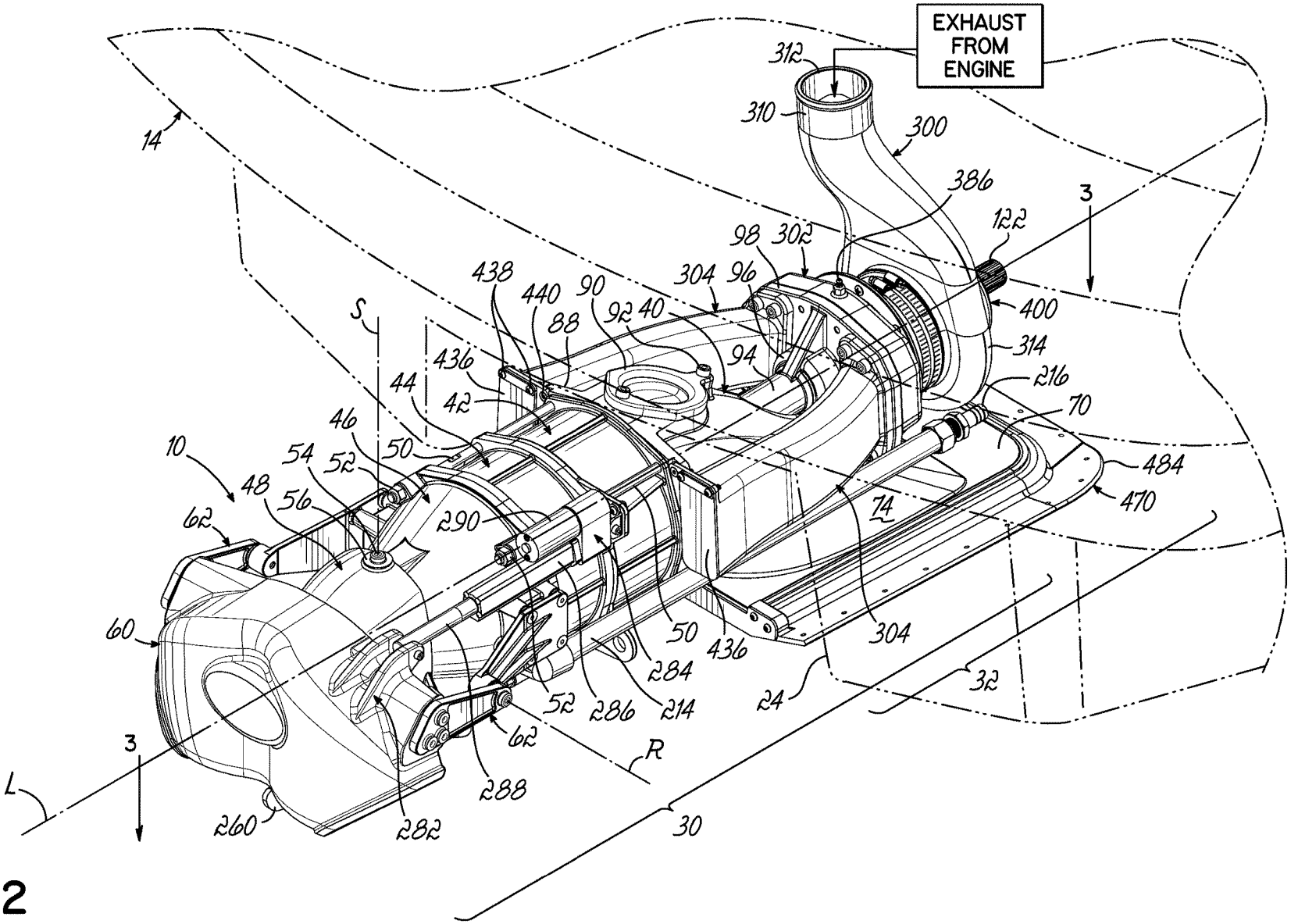
FIG. 2 is a magnified perspective view of the jet pump of FIG. 1, showing the hull of the motorboat in phantom.

As best shown in FIG. 2, the illustrated jet pump 10 includes a propulsion system 30 and an integrated exhaust system 32 for safely directing exhaust from the engine 5 to the exterior of the motorboat 12. As described below, the integration of the propulsion system 30 shown in detail in FIG. 2A and the exhaust system 32 shown in detail in FIG. 2B may contribute to the compact configuration of the jet pump 10 which may provide a relatively quick and efficient plug and play style of installation. As shown in FIG. 2, the propulsion system 30 is generally downstream or rearward from the exhaust system 32.

Figure 2A:
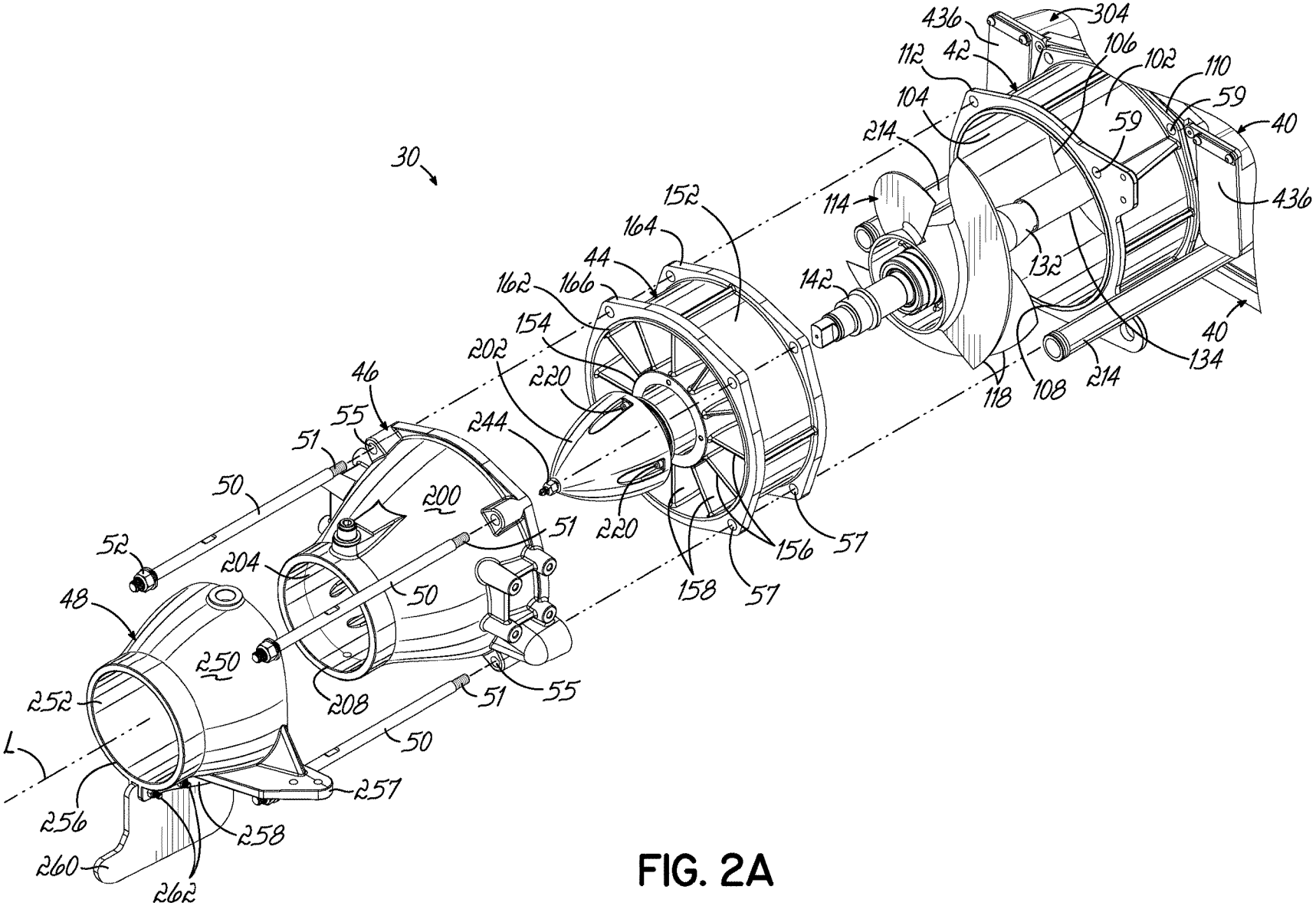
FIG. 2A is a perspective disassembled view of the propulsion system of the jet pump shown in FIG. 2.
Figure 2B:
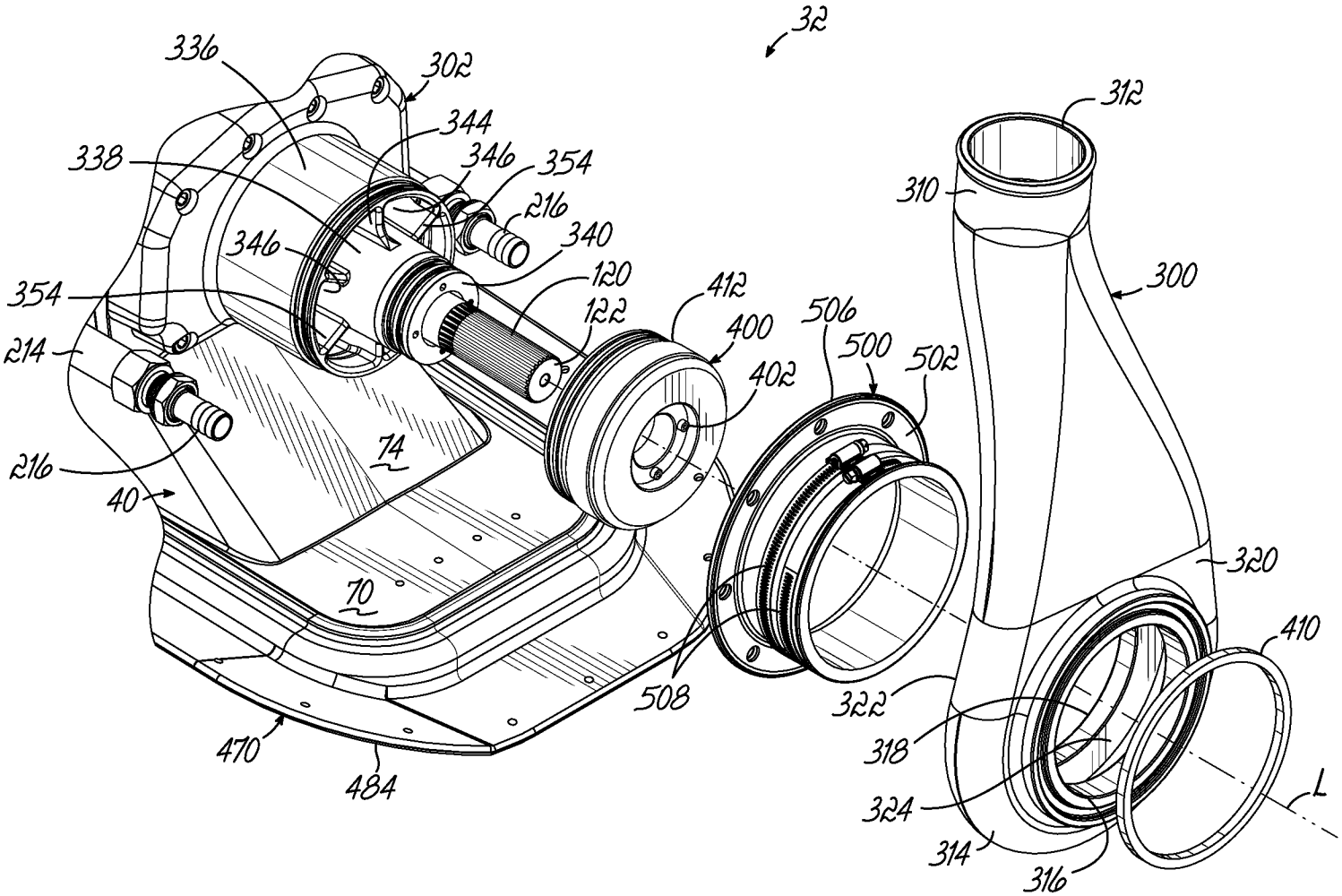
FIG. 2B is a perspective disassembled view of the exhaust system of the jet pump shown in FIG. 2.
Figure 2C:
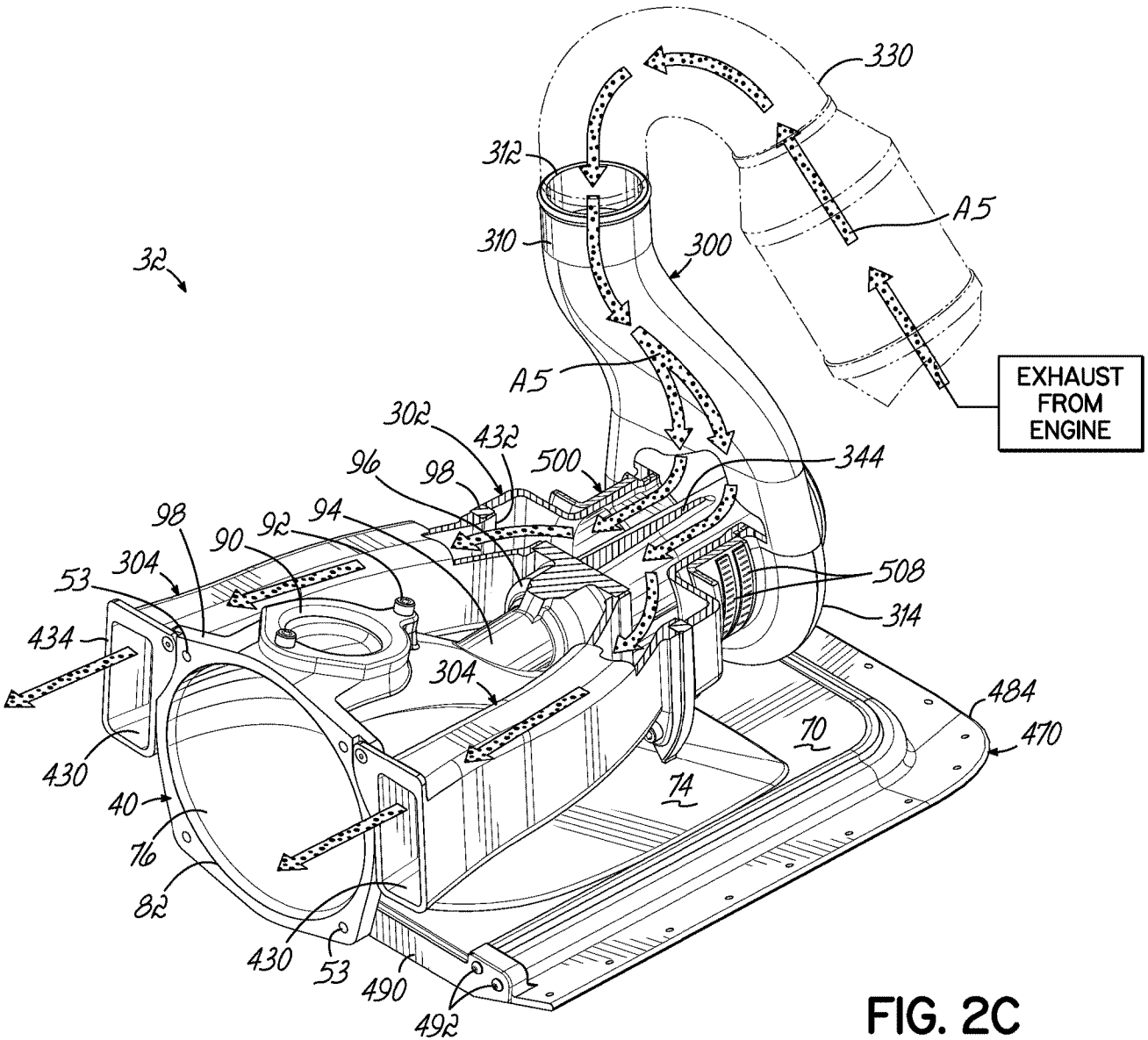
FIG. 2C is a cutaway perspective of the exhaust system of the jet pump shown in FIG. 2, showing the exhaust flow path.
Figure 7:
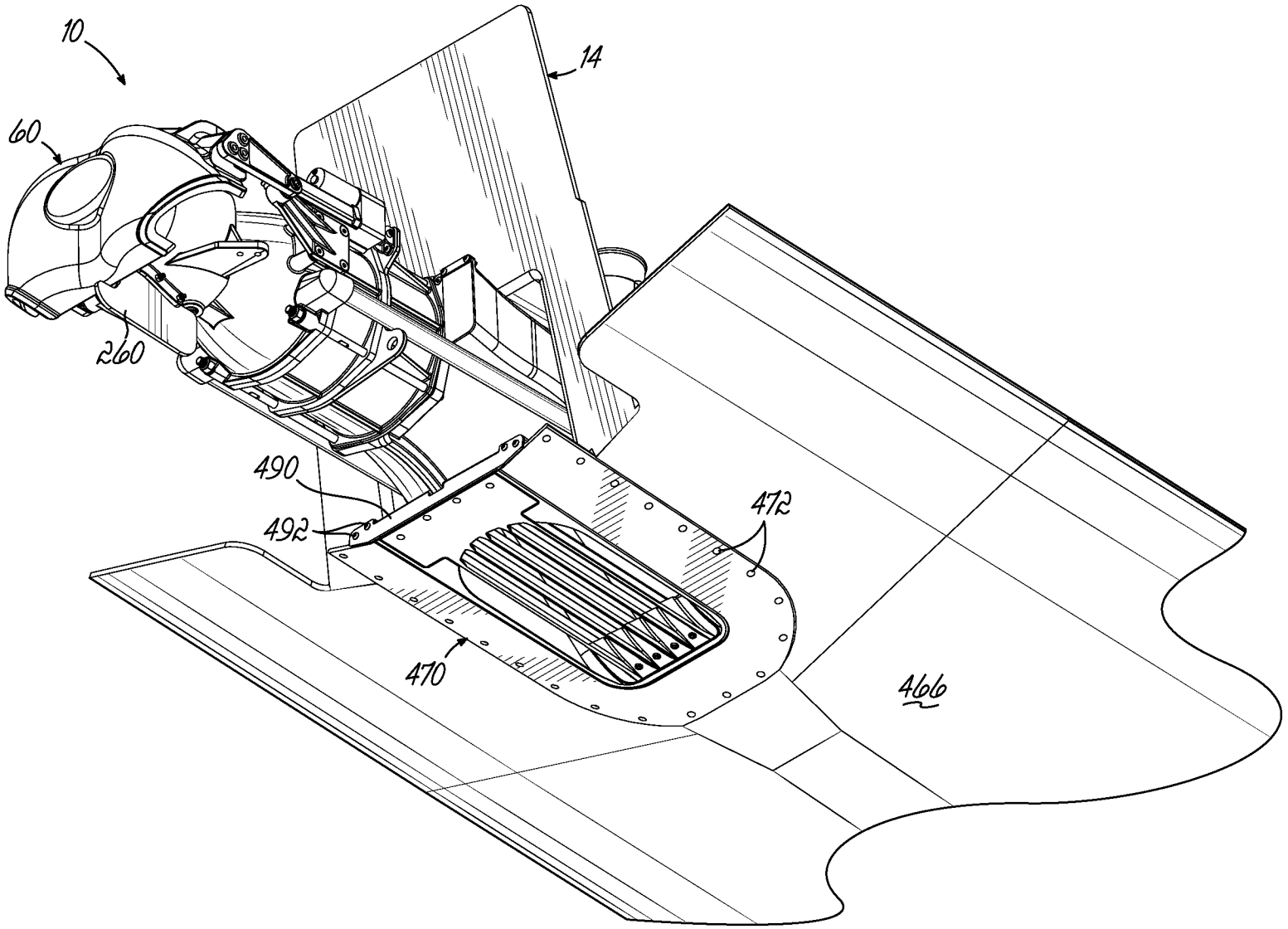
FIG. 7 is a perspective view of the jet pump of FIG. 1, showing the jet pump coupled to an exterior of the hull of the boat.
Figure 7A:
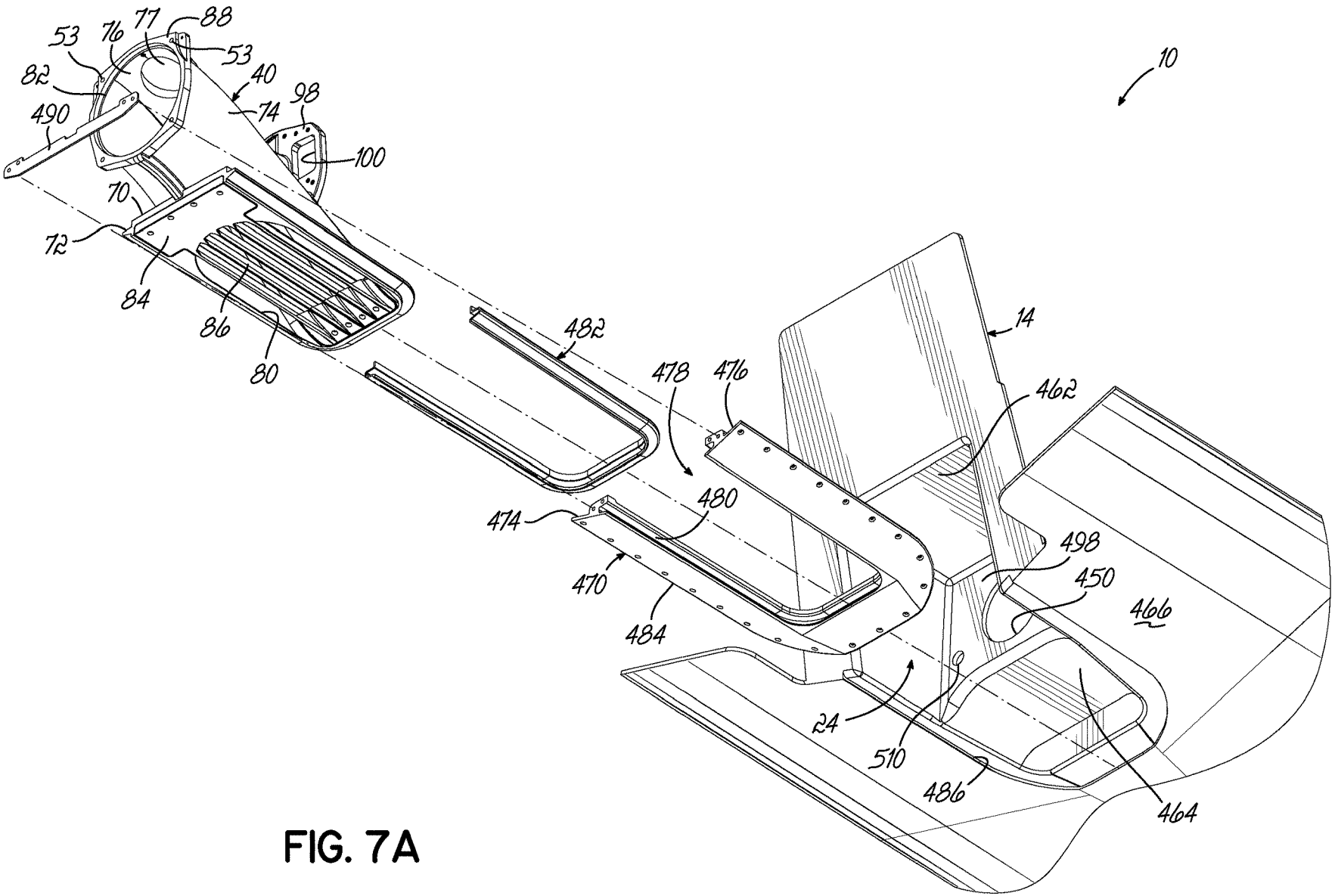
FIG. 7A is a partial perspective disassembled view of the jet pump shown in FIG. 7, showing a vibration isolator between the water intake and the intake mount.

Referring now to FIGS. 2, 2A, 2C, 3, 3A, 3B and 7A, the propulsion system 30 of the jet pump 10 includes a water intake 40, best shown in FIG. 7A. The propulsion system 30 of the jet pump 10 further comprises an impeller housing 42 downstream or behind the water intake 40, a stator 44 downstream or behind the impeller housing 42, a jet nozzle 46 downstream or behind the stator 44, and a steering nozzle 48 arranged along a jet pump longitudinal axis L. See FIG. 2A. Together these components are configured to produce thrust by directing water out of the steering nozzle 48 using water taken in by the water intake 40 to propel the motorboat 12. As best shown in FIG. 2A, the water intake 40, impeller housing 42, stator 44, and jet nozzle 46 are fixedly coupled to each other via a plurality of fasteners, such as studs 50 and accompanying nuts 52. As shown in FIGS. 2A and 2C, threaded ends 51 of the studs 50 are sized to screw into threaded openings 53 in the water intake 40. As best shown in FIG. 2A, studs 50 pass through openings 55 in the jet nozzle 46, openings 57 in the stator 44 and openings 59 in the impeller housing 42 for the proper alignment of these components. The steering nozzle 48 is pivotably coupled to the jet nozzle 46 via one or more fasteners 54 and/or bushings 56. See FIG. 2.

In the embodiment shown, the propulsion system 30 also includes a reverse bucket 60 positioned downstream from the steering nozzle 48 and pivotably coupled to the jet nozzle 46 via one or more linkages 62, as described in greater detail below. See FIG. 2. In the embodiment shown, the water intake 40, impeller housing 42, stator 44, jet nozzle 46, and steering nozzle 48 are each positioned external to the hull 14 of the motorboat 12.

Figure 3:
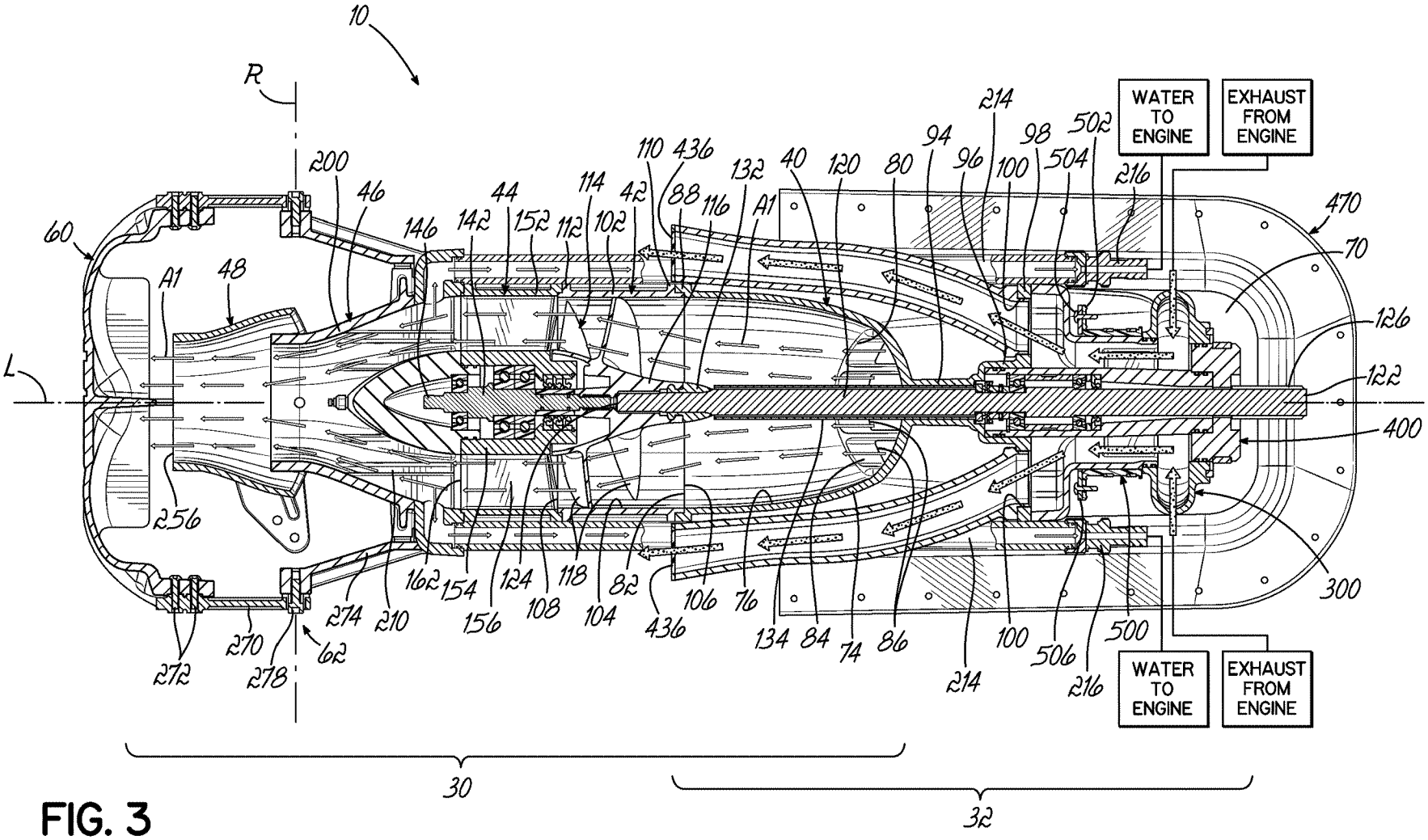
FIG. 3 is a cross sectional view of the jet pump taken along section line 3-3 in FIG. 2, showing the water and exhaust flow paths.

As best shown in FIG. 3, the water intake 40, impeller housing 42, stator 44, jet nozzle 46, and steering nozzle 48 are each at least partially hollow to collectively define a water flow path, as indicated by the arrows A1. As best shown in FIG. 7A, the water intake 40 includes a generally rectangular base 70 having a lip 72 extending at least partially about the periphery thereof, and a main body 74 defining an intake passageway 76 extending between an inlet 80 and an outlet 82. As best shown in FIG. 7A, the water intake 40 includes an intake grate 84 including a plurality of intake apertures 86 for communicating with a body of water. The intake grate 84 is positioned at or near the inlet 80 of the water intake 40 for allowing entry of water into the intake passageway 76 while inhibiting entry of undesirable objects such as debris. The intake grate 84 may be separately formed from the base 70 and coupled thereto or may be integrally formed with the base 70 as a unitary piece. In the embodiment shown, the water intake 40 includes a mounting flange 88 positioned at or near the outlet 82 for coupling the water intake 40 to the impeller housing 42 and/or other components of the jet pump 10, as shown in FIG. 2. As best shown in FIGS. 2 and 2C, the water intake 40 also includes a cleanout cover 90 removably coupled to the main body 74 via one or more fasteners 92 for providing access to the intake passageway 76 through an opening 77 in the main body 74, as shown in FIG. 7A, such as for maintenance purposes. As best shown in FIGS. 2C and 3, the water intake 40 further includes a conduit portion 94 extending outwardly from the main body 74 of the water intake 40 along the longitudinal axis L of the jet pump 10 and terminating at a conduit port 96 at the upstream end of the conduit portion 94, as well as a mounting plate 98 including a pair of apertures 100 and extending upwardly from the main body 74 to intersect the conduit port 96, the purposes of which are described below.

As best shown in FIGS. 2A and 3, the impeller housing 42 includes a generally cylindrical shell 102 defining an impeller passageway 104 extending between an inlet 106 and an outlet 108. In the embodiment shown, the impeller housing 42 includes first and second mounting flanges 110, 112 positioned at or near the inlet 106 and outlet 108, respectively, for coupling the impeller housing 42 to the water intake 40, the stator 44, and/or other components of the jet pump 10. As shown, an impeller 114 is positioned within the impeller passageway 104 and is sized and configured to rotate therein. As best shown in FIG. 3B, the impeller 114 includes a hub 116 and a plurality of blades 118 extending radially outwardly from the hub 116. Although the blades 118 are illustrated having a particular configuration, the drawings are not intended to limit the configuration or shape of the blades 118. The impeller 114 is fixedly mounted to at least one rotatable shaft 120 of the jet pump 10 in any known manner for causing the impeller 114 to rotate inside the impeller passageway 104.

As shown in FIG. 3, a relatively long primary shaft 120 extends along the longitudinal axis L of the jet pump 10 between an external input end 122 and an internal output end 124 positioned within the impeller housing 42. As best shown in FIG. 3C, the input end 122 of primary shaft 120 includes a first splined outer surface 126 for engaging with a rotating component of the engine 5 for transferring torque to the primary shaft 120. As best shown in FIG. 3B, the output end 124 of the primary shaft 120 includes a second splined outer surface 128 for engaging with a splined inner surface 130 of the impeller 114 for transferring such torque to the impeller 114 to cause the impeller 114 to rotate. As shown in FIG. 3B, a flexible seal or nose 132 is positioned between the primary shaft 120 and the impeller 114 to prevent water or contaminants from passing therebetween. As shown in FIGS. 3 and 3C, the primary shaft 120 is at least partially housed within a shaft tube 134 which extends across the intake passageway 76 and through the conduit portion 94 of the water intake 40. Axial movement of the shaft tube 134 is limited by the interaction of a flange 136 of the shaft tube 134 with a shoulder 138 provided at or near the conduit port 96 (FIG. 3D). A face seal assembly 140 positioned over the primary shaft 120 may also assist in limiting axial movement of the shaft tube 134, as described in greater detail below.

In the embodiment shown, the impeller 114 is also coupled to a relatively short secondary shaft 142 extending along the longitudinal axis L between first and second ends 144, 146. As best shown in FIG. 3B, the first end 144 includes a threaded outer surface 148 for engaging with a threaded inner surface 150 of the impeller 114 for fixedly coupling together the secondary shaft 142 and the impeller 114. In this manner, the primary shaft 120, impeller 114, and secondary shaft 142 are rotatable together as a single body. In another embodiment, one or more of the primary shaft 120, impeller 114, and secondary shaft 142 may be integrally formed together as a unitary piece(s).

The illustrated stator 44 includes a generally cylindrical outer shell 152, a central portion 154, and a plurality of stationary vanes 156 extending therebetween to define a plurality of stator passageways 158 extending at least partially between an inlet 160 and an outlet 162 of the stator 44. Together, the rotating blades 118 of the impeller 114 and stationary vanes 156 of the stator 44 are configured to increase the pressure of water traveling through the water flow path by diffusing the flow of the water in order to generate thrust. The water flow is accelerated by the rotating blades 118 of the impeller 114 to pass through the reducing area between the hub 116 of the impeller 114 and the inner wall of the stator 44. This accelerates the water flow with some spiral action in the flow. The vanes 156 of the stator 44 may support the central portion 154 and/or the secondary shaft 142, for example, and/or may assist in straightening the water flow and reducing the spiral action as the water flow travels through the jet nozzle 46 and steering nozzle 48. In the embodiment shown, the outer shell 152 of the stator 44 includes first and second mounting flanges 164, 166 positioned at or near the inlet 160 and outlet 162, respectively, for coupling the stator 44 to the impeller housing 42, the jet nozzle 46, and/or other components of the jet pump 10.

Figure 3A:
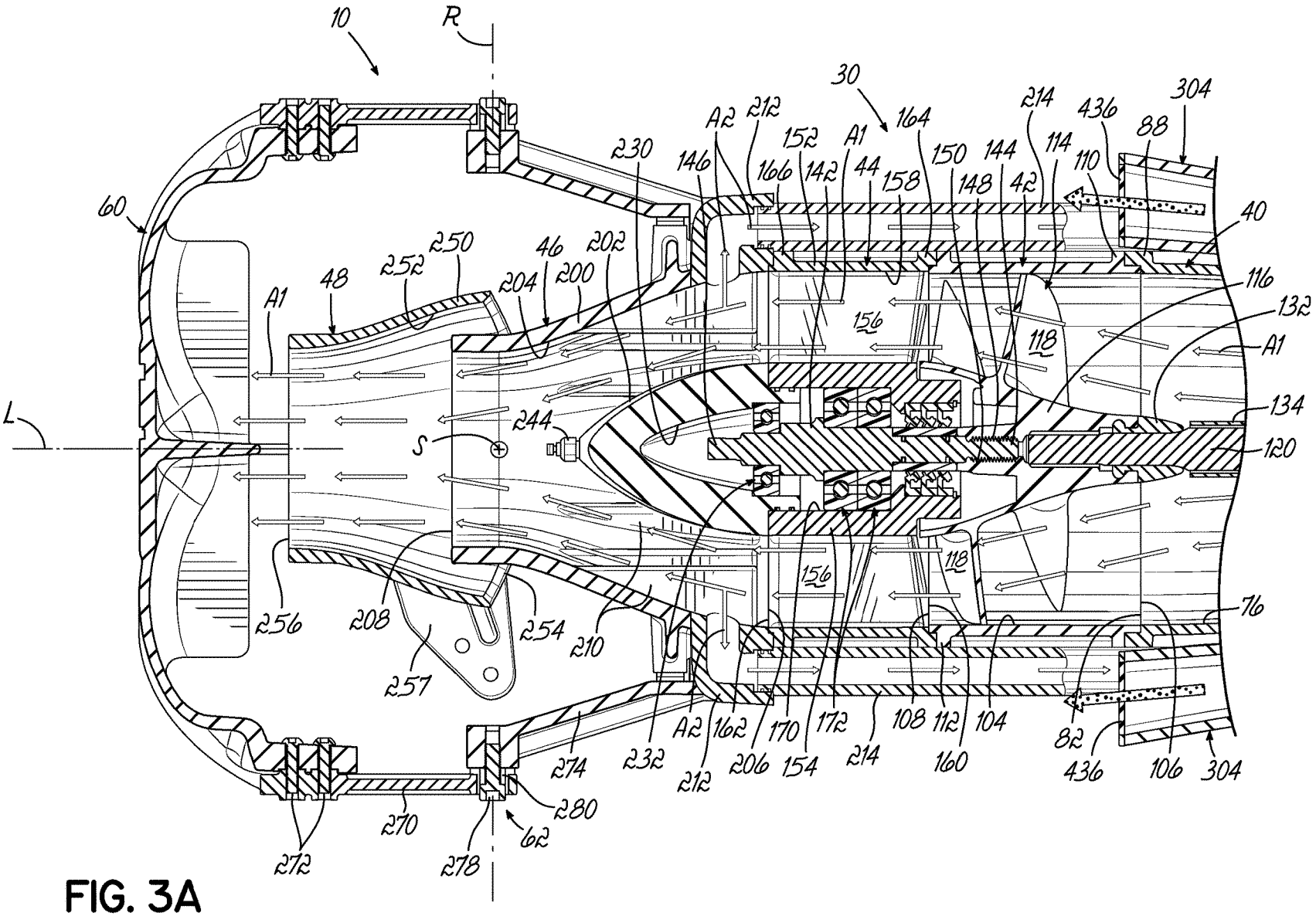
FIG. 3A is a cross sectional view similar to FIG. 3, magnified to focus on the propulsion system of the jet pump.
Figure 3B:
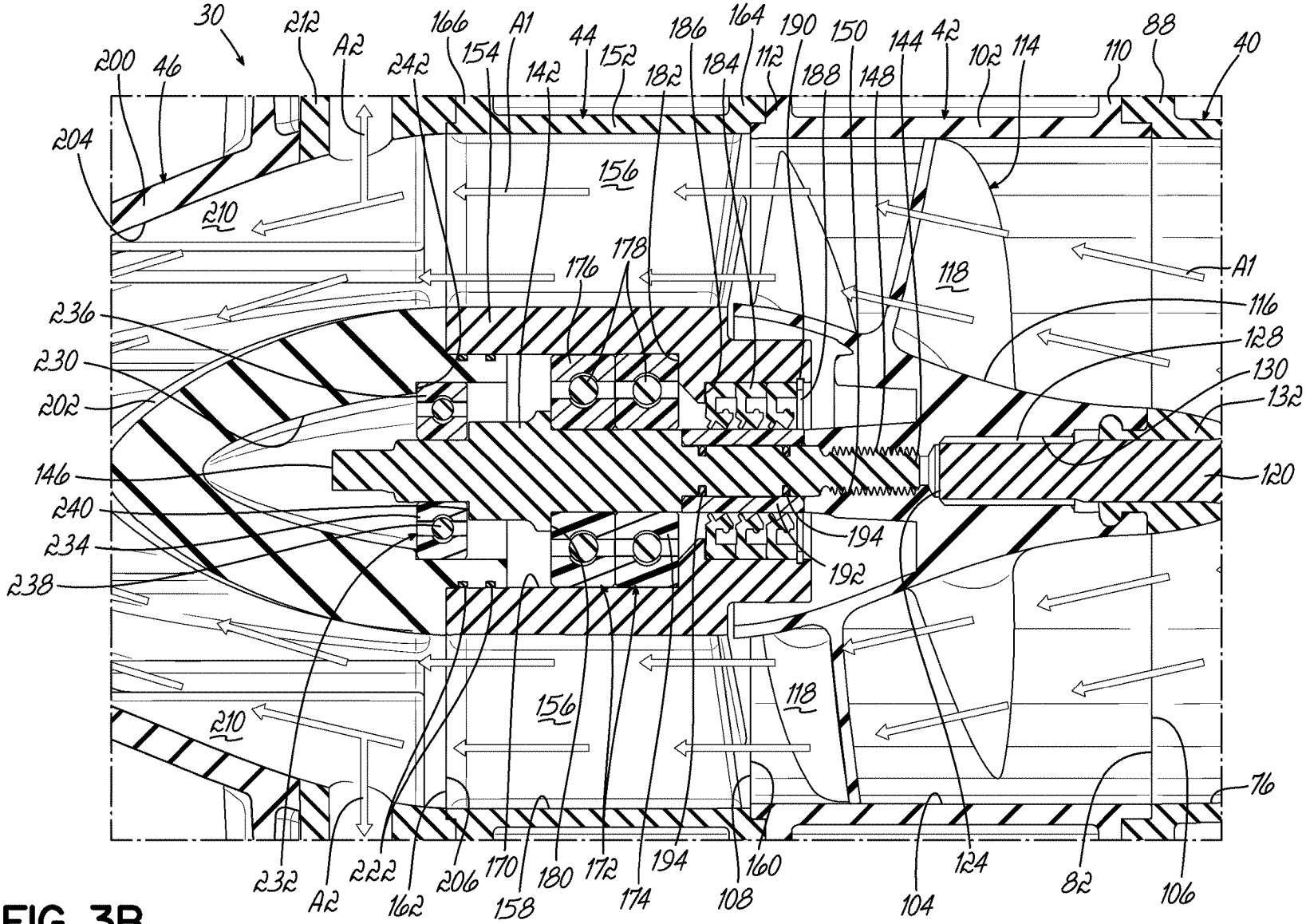
FIG. 3B is a cross sectional view similar to FIG. 3A, further magnified to focus on various components of the propulsion system.
Figure 3C:
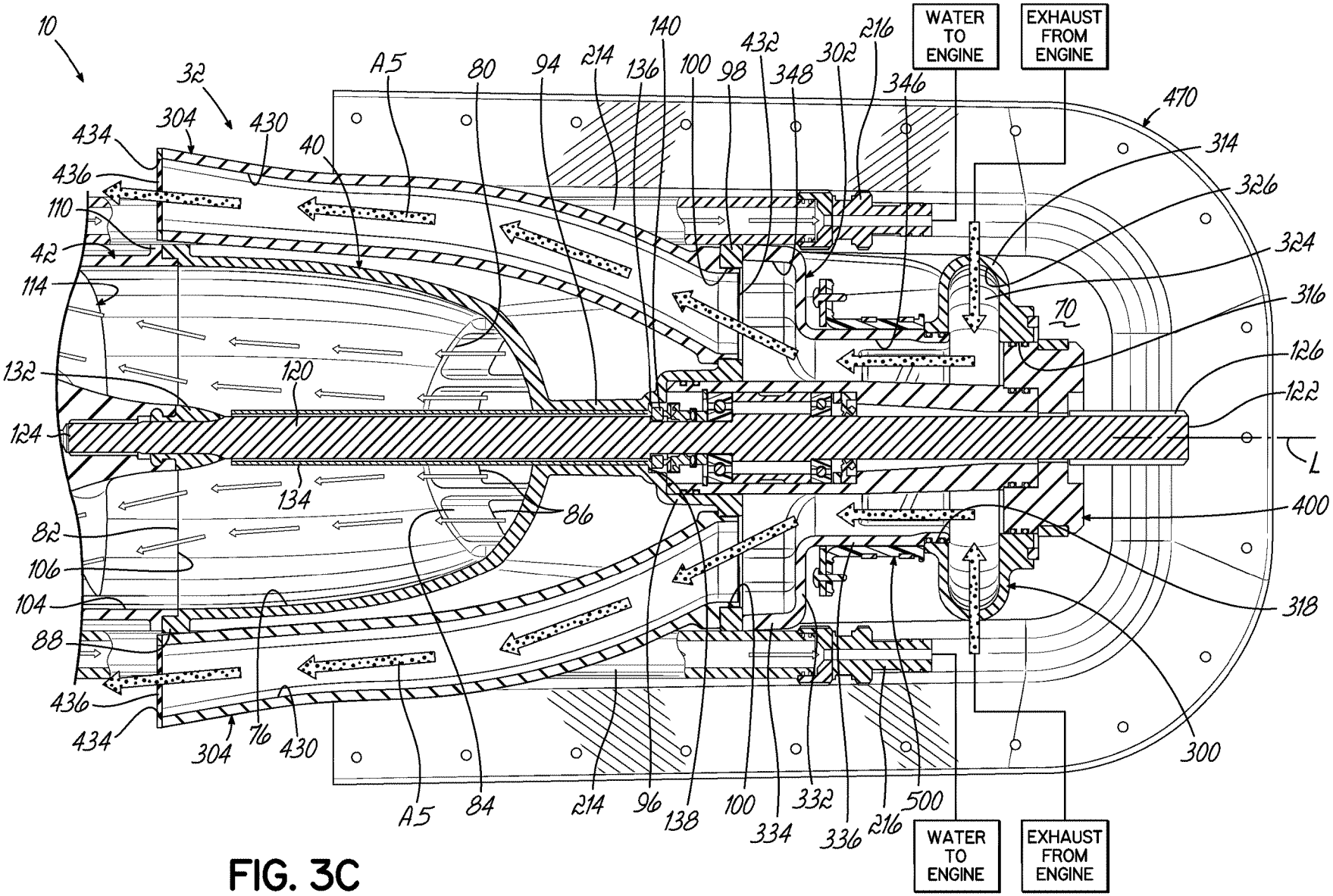
FIG. 3C is a cross sectional view similar to FIG. 3, magnified to focus on the exhaust system of the jet pump.
Figure 3D:
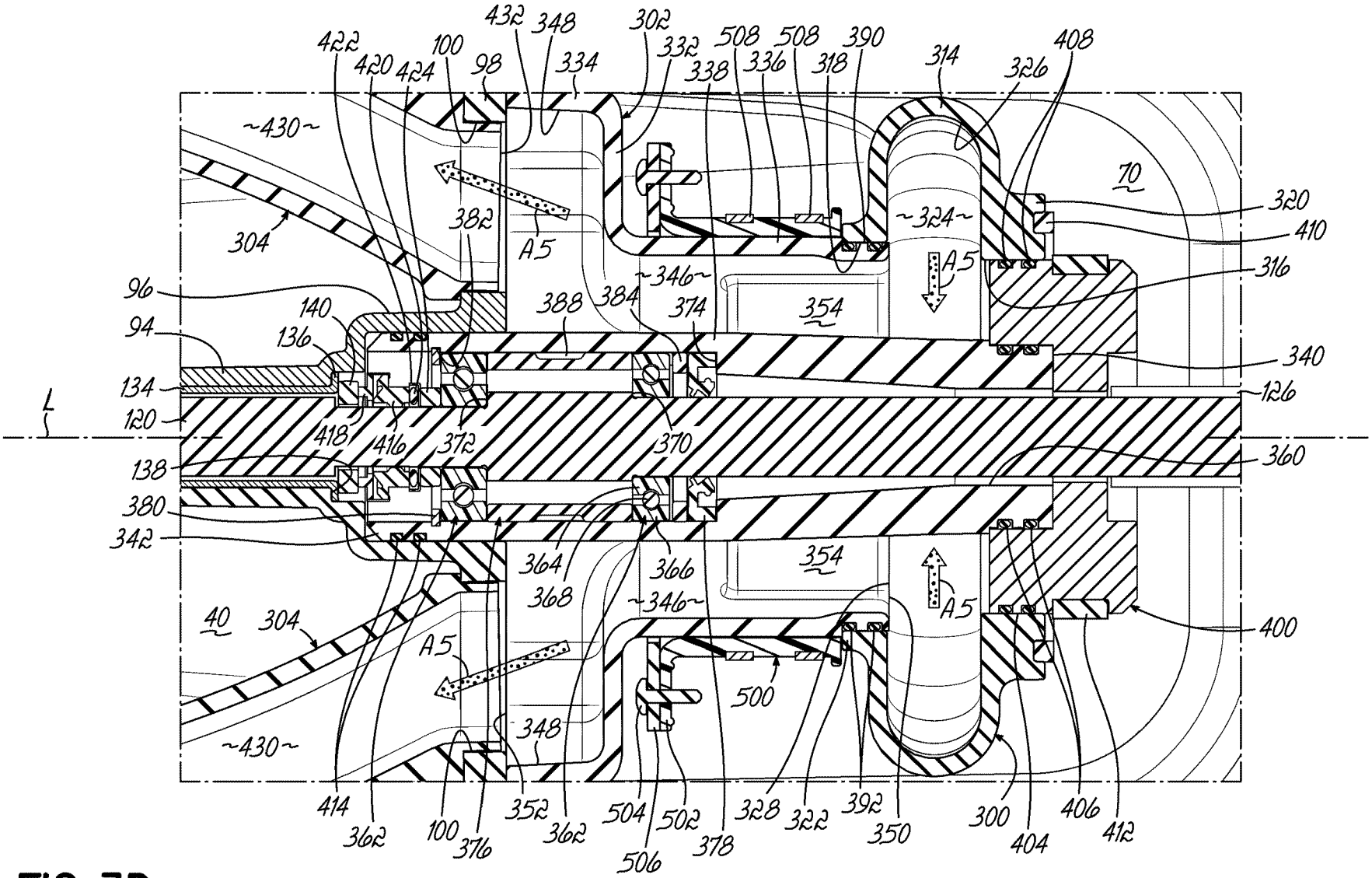
FIG. 3D is a cross sectional view similar to FIG. 3A, further magnified to focus on various components of the exhaust system.

As best shown in FIGS. 3A and 3B, the central portion 154 of the stator 44 includes a bore 170 extending along the longitudinal axis L of the jet pump 10 for accommodating a portion of the secondary shaft 142. In this regard, a pair of ball bearings 172 are positioned within the bore 170 for rotatably supporting the secondary shaft 142 along its length. As shown in FIG. 3B, each ball bearing 172 includes an inner race 174, an outer race 176, and a plurality of bearing balls 178. The illustrated secondary shaft 142 includes a shoulder 180 for assisting in retaining the inner races 174 of the ball bearings 172 relative to the secondary shaft 142 and the central portion 154 includes a shoulder 182 for assisting in retaining the outer races 176 of the ball bearings 172 relative to the central portion 154. Thus, the inner races 174 of the ball bearings 172 are rotatable together with the secondary shaft 142 while the outer races 176 are fixed relative to the stator 44. One or more seals 184 are positioned between the secondary shaft 142 and the central portion 154 of the stator 44 to prevent water or contaminants from passing therebetween. As shown, the seals 184 may be sandwiched between a shoulder 186 of the bore 170 and a retaining ring 188 positioned in a groove 190 of the bore 170. In the embodiment shown, a sleeve 192 is positioned between the secondary shaft 142 and the one or more seals 184 and a pair of O-rings 194 are positioned between the secondary shaft 142 and the sleeve 192 to provide a fluid-tight seal therebetween.

As best shown in FIG. 3A, the jet nozzle 46 includes a generally frustoconical shell 200 and a tail cone 202 positioned within the frustoconical shell 200 which together define a jet nozzle passageway 204 extending between an inlet 206 and an outlet 208. The jet nozzle passageway 204 converges the water received from the stator 44 to convert the resulting pressure energy into velocity, thereby producing thrust. The illustrated jet nozzle 46 also includes a plurality of fins 210 extending generally parallel to the longitudinal axis L of the jet pump 10 for encouraging the water received from the stator 44 to flow in a generally linear, axial direction toward the steering nozzle 48. As shown in FIG. 3A, the jet nozzle 46 may include a pair of water outlets 212 in communication with water pipes 214 which terminate at respective water pipe fittings 216 for directing a relatively small portion of the water taken in from the water intake 40 to a cooling system heat exchanger of the engine 5 for cooling purposes, as indicated by the arrows A2. The water flowing between the water pipes 214 flows upstream or from left to right in FIG. 3A. While two water pipes 214 and accompanying water pipe fittings 216 are shown, it will be appreciated that only a single water pipe 214 and accompanying water pipe fitting 216 may be used to supply water to the engine 5 such that the other may be eliminated. For example, certain engine designs may only require the portside water pipe 214 such that the starboard-side water pipe 214 may be eliminated, while other engine designs may only require the starboard-side water pipe 214 such that the portside water pipe 214 may be eliminated. In addition, or alternatively, one of the water pipes 214 may be used to supply water to a component other than the engine 5 for cooling purposes, and/or may be used to supply water to a ballast tank, for example. In other embodiments, the water pipes 214 may be omitted.

As best shown in FIG. 2A, the tail cone 202 is fixedly coupled to the central portion 154 of the stator 44 by one or more fasteners 220. As best shown in FIG. 3B, a pair of O-rings 222 are positioned between the tail cone 202 and the central portion 154 of the stator 44 to provide a fluid-tight seal therebetween. The tail cone 202 has an internal cavity 230 including at least one ball bearing 232 for rotatably supporting the secondary shaft 142 at or near the second end 146. The ball bearing 232 includes an inner race 234, an outer race 236, and a plurality of bearing balls 238. The illustrated secondary shaft 142 includes a shoulder 240 for assisting in retaining the inner race 234 of the ball bearing 232 relative to the secondary shaft 142 and the tail cone 202 includes a shoulder 242 for assisting in retaining the outer race 236 of the ball bearing 232 relative to the tail cone 202. Thus, the inner race 234 of the ball bearing 232 is rotatable together with the secondary shaft 142 while the outer race 236 is fixed relative to the tail cone 202 and stator 44. As shown in FIG. 3A, the tail cone 202 also includes a grease fitting 244 positioned at or near a tip of the tail cone 202 for supplying grease to the ball bearing 232, for example.

The steering nozzle 48 includes a generally frustoconical shell 250 defining a steering nozzle passageway 252 extending between a clearance slot 254 and an outlet 256. As described above, the steering nozzle 48 is pivotably coupled to the jet nozzle 46, such as via one or more fasteners 54 and/or bushings 56, to define a steering axis S about which the steering nozzle 48 may rotate. See FIGS. 3A, 4A and 4B. Rotation of the steering nozzle 48 about the steering axis S may be bounded by interaction between the jet nozzle 46 and the periphery of the clearance slot 254. In the position shown in FIG. 3, the water flow exiting the jet nozzle 46 may pass through and exit the steering nozzle 48 in a generally straight direction along the jet pump longitudinal axis L, thereby generating thrust along the jet pump longitudinal axis L for propelling the motorboat 12 in a generally straight forward or reverse direction (depending on the position of the reversing bucket 60, as described below). Rotation of the steering nozzle 48 about the steering axis S may effectively redirect water flow exiting the jet nozzle 46 from a generally axial direction to a direction angled with respect to the jet pump axis L, thereby generating vectored thrust for turning the motorboat 12. In this regard, the illustrated steering nozzle 48 includes a steering cable flange 257 for operatively coupling the steering nozzle 48 to a steering cable or other steering device (not shown) for controlling the rotation of the steering nozzle 48 relative to the steering axis S. In the embodiment shown, the steering nozzle 48 also includes one or more rudder mounting flanges 258 for removably coupling any suitable rudder 260 (FIG. 2A) to the steering nozzle 48, such as via fasteners 262, for redirecting water flow in the water body behind the motorboat 12 to impart a yawing motion to the motorboat 12 and thereby assist in controlling the direction of movement of the motorboat 12.

Figure 4A:
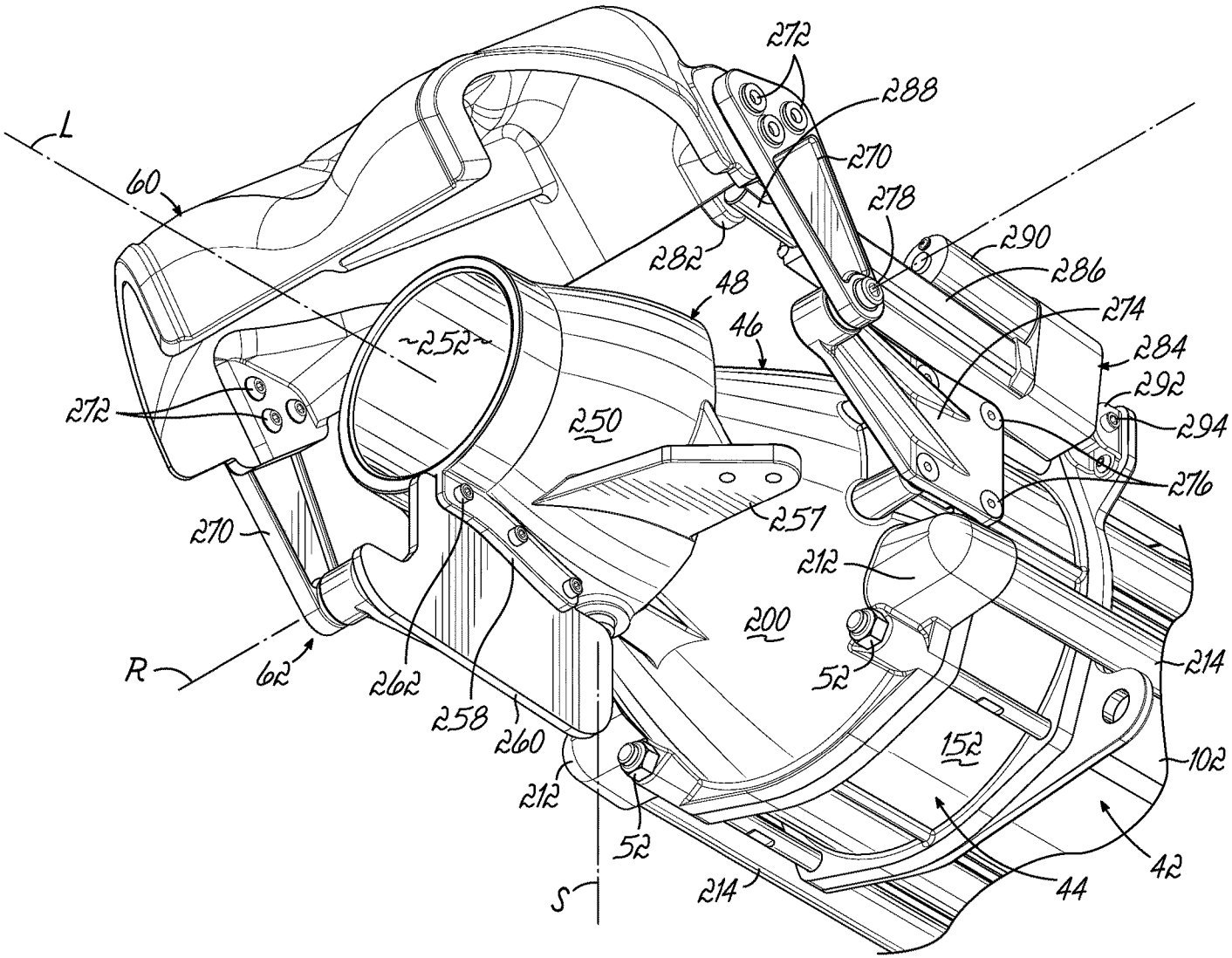
FIG. 4A is a partial perspective view of the jet pump showing the steering nozzle and rudder aligned in a first, straight direction for providing forward thrust.
Figure 4B:
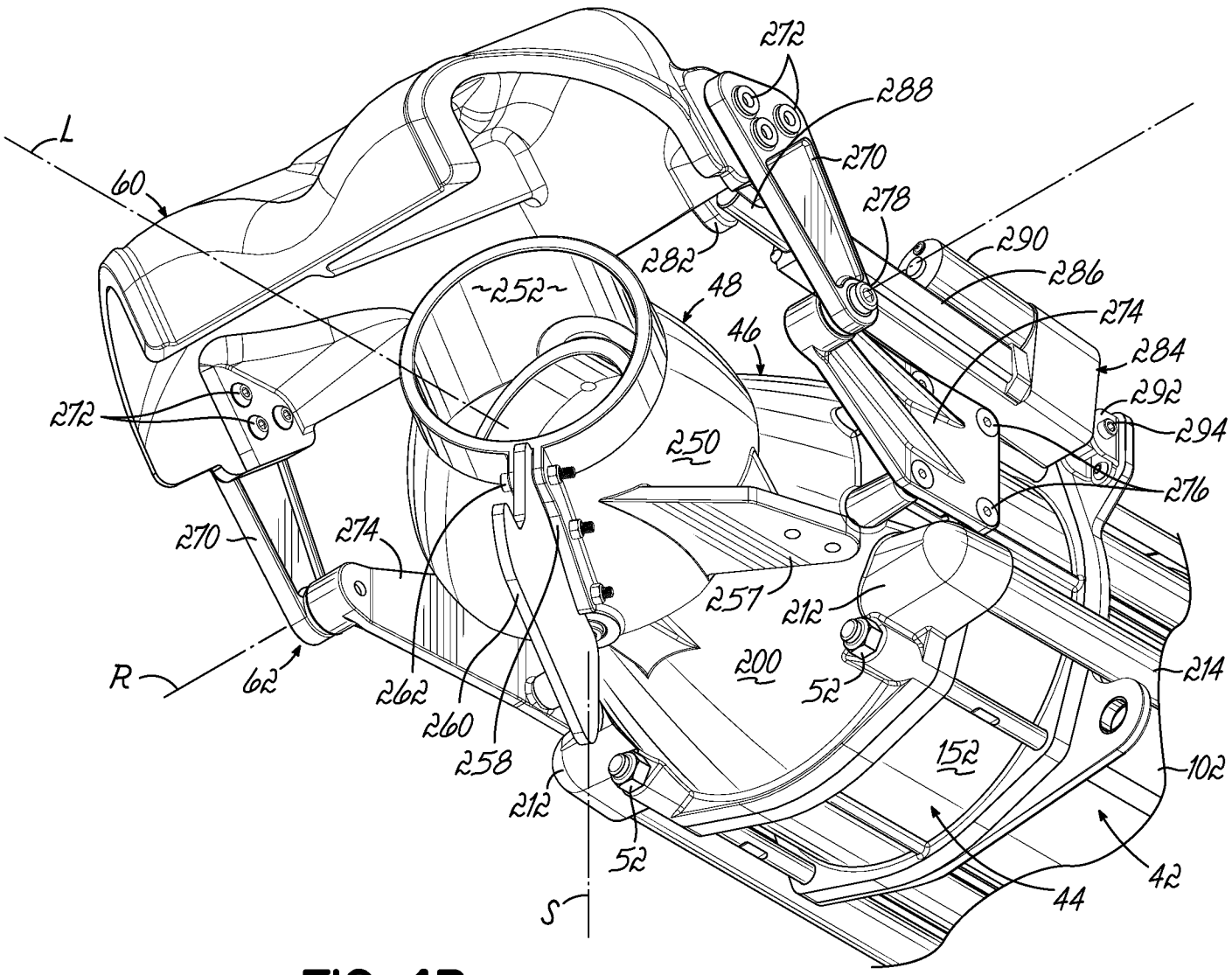
FIG. 4B is a partial perspective view similar to FIG. 4A showing the steering nozzle and rudder aligned in a second, turned direction for providing vectored thrust.

Operation of the steering nozzle 48 and rudder 260 is illustrated in FIGS. 4A and 4B. In particular, the steering nozzle 48 and rudder 260 may be together aligned with the jet pump longitudinal axis L in order to achieve straight propulsion of the motorboat 12 along the jet pump longitudinal axis L (FIG. 4A). Rotation of the steering nozzle 48 about the steering axis S causes the rudder 260 to simultaneously rotate about the steering axis S. Thus, the steering nozzle 48 and rudder 260 may be together rotated about the steering axis S so as to be oriented at an angle relative to the jet pump longitudinal axis L in order to achieve angled and/or curved propulsion of the motorboat 12 (FIG. 4B). In an alternative embodiment, the rudder 260 may be eliminated such that the steering nozzle 48 may be the sole primary steering means.

Figure 5A:
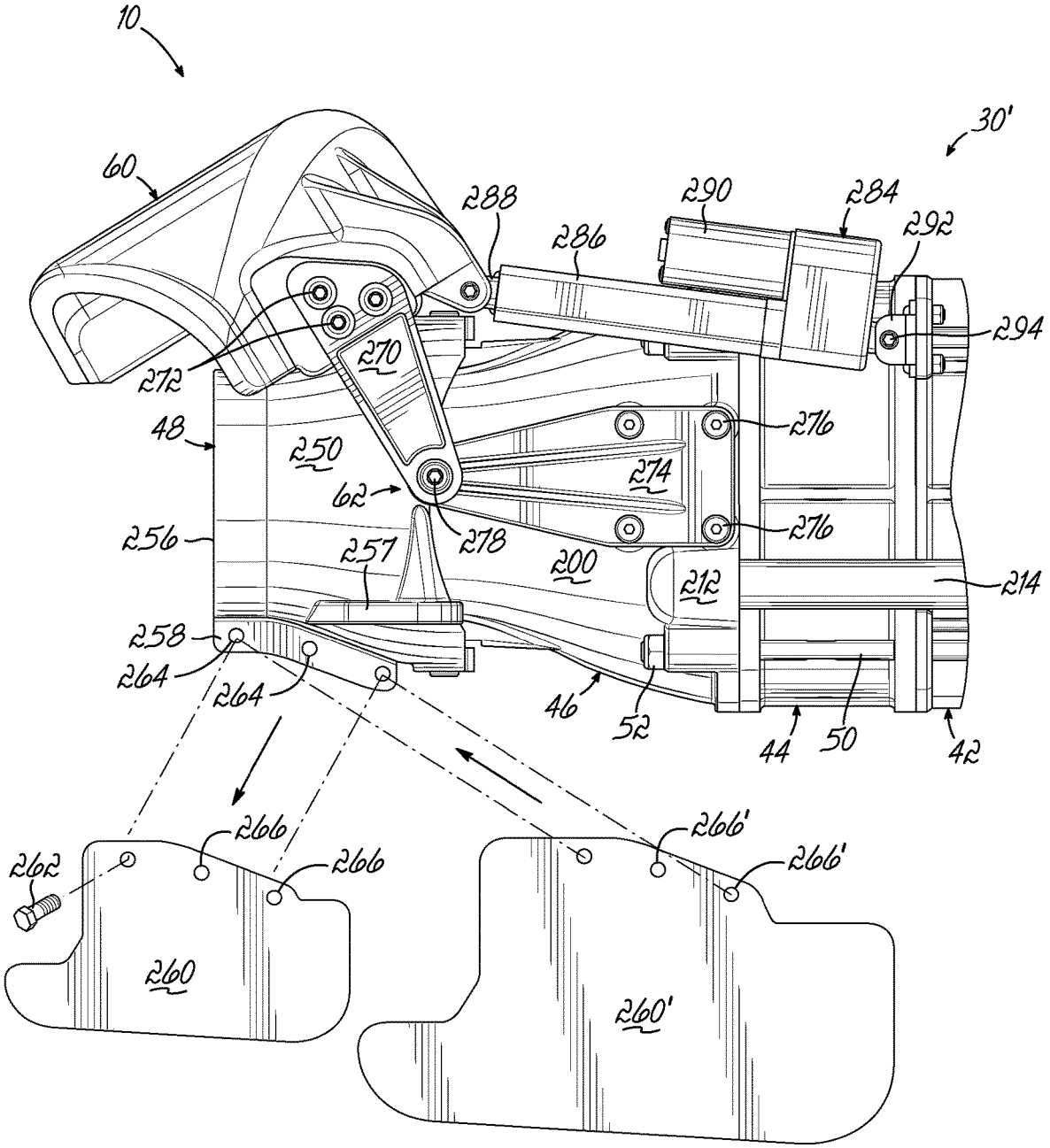
FIG. 5A is a side view of a portion of the jet pump illustrating the removability and replaceability of a first rudder of the jet pump.
Figure 5B:
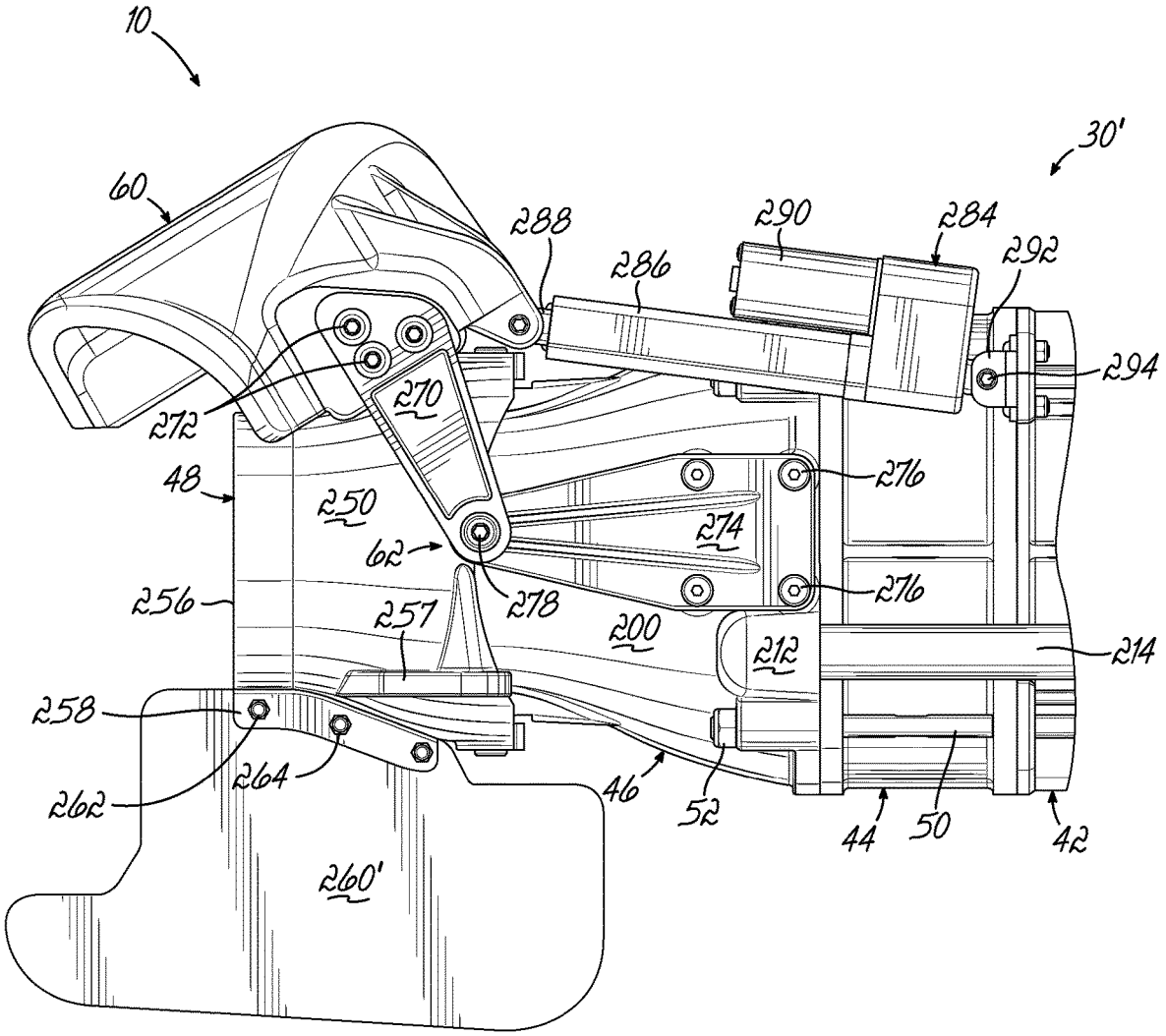
FIG. 5B is a side view similar to FIG. 5A showing a second rudder coupled to the jet pump.

Interchangeability of the rudder 260 is illustrated in FIGS. 5A and 5B. In particular, the rudder 260 may be decoupled from the rudder mounting flange 258, such as by removing the one or more fasteners 262 (FIG. 5A), and a second rudder 260' having a different size and/or configuration (e.g., relatively larger) may be removably coupled to the rudder mounting flange 258 in place of the original rudder 260, such as via the same one or more fasteners 262 (FIG. 5B), to provide a modified propulsion system 30'. In this regard, the rudder mounting flange 258 may include mounting holes 264 for receiving the fasteners 262 and each rudder 260, 260' may include corresponding mounting holes 266, 266' having a standardized size and/or configuration such that any suitable rudder 260, 260' may be removably coupled to the rudder mounting flange 258 as may be desired. For example, the original rudder 260 may be particularly suitable for a motorboat 12 having a relatively small size, while the second, larger rudder 260' may be particularly suitable for a motorboat having a relatively large size (not shown). Such interchangeability may allow a single jet pump 10 to be suitable for a wide variety of watercraft.

Figure 6A:
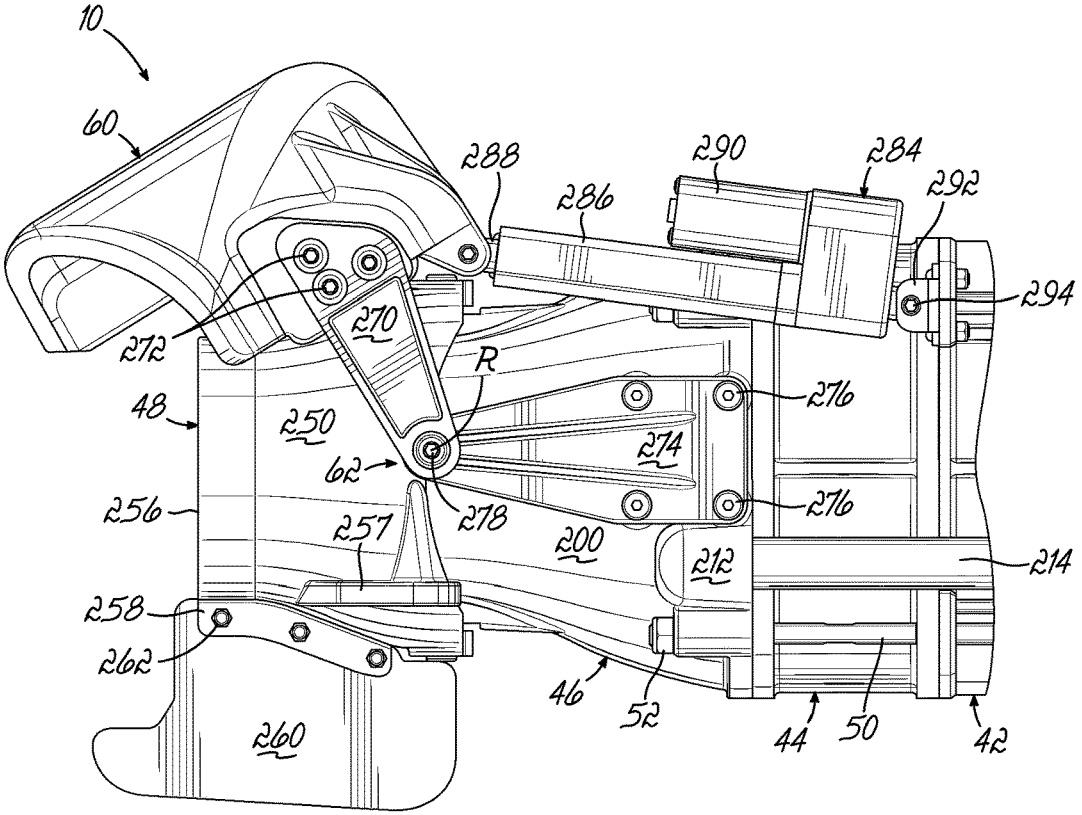
FIG. 6A is a side view of a portion of the jet pump showing the reverse bucket in an up position.
Figure 6B:
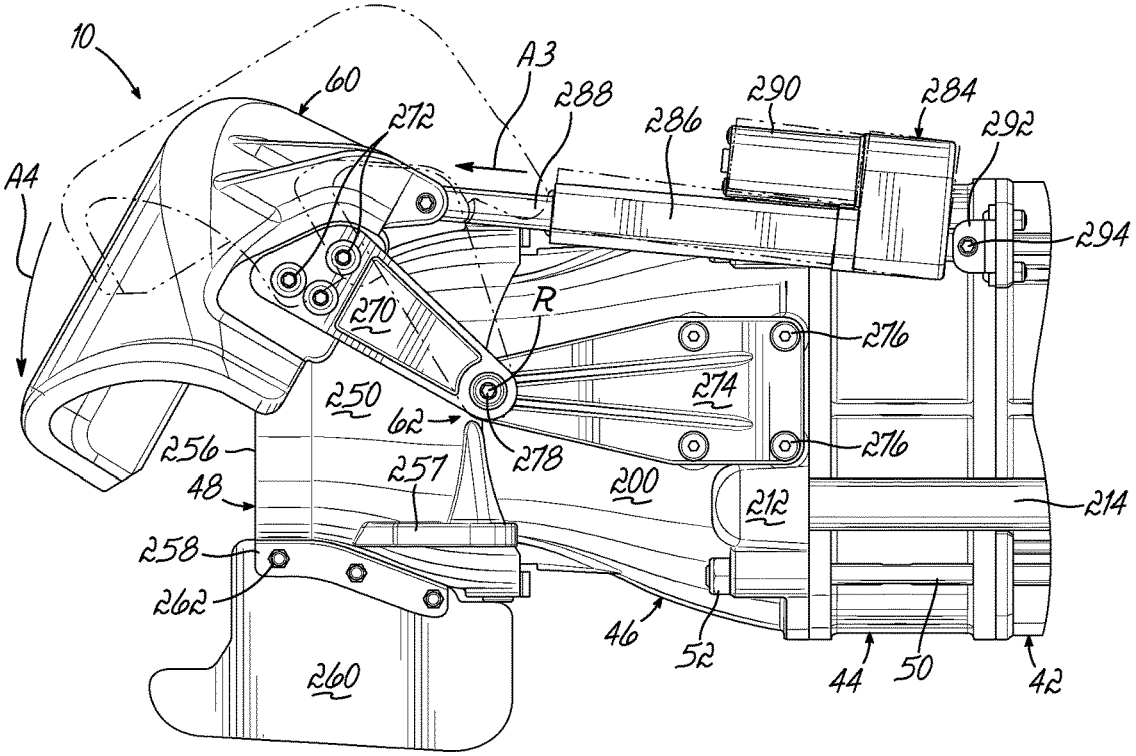
FIG. 6B is a side view of a portion of the jet pump showing the reverse bucket in an intermediate or neutral position.
Figure 6C:
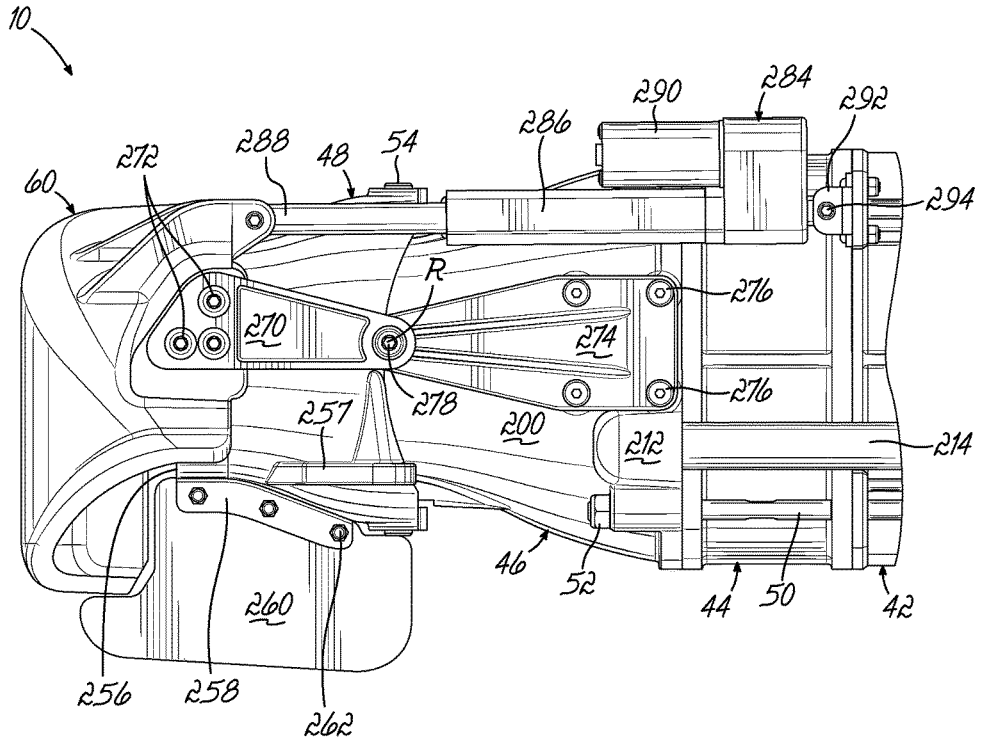
FIG. 6C is a side view of a portion of the jet pump showing the reverse bucket in a down position.

With reference again to FIGS. 2, 2A, 3, and 3A, the reversing bucket 60 is configured to obstruct the outlet 256 of the steering nozzle 48 when placed in a down position to deflect the water flow exiting the steering nozzle 48 in order to achieve reverse thrust for propelling the motorboat 12 in a reverse direction and/or for opposing the direction of travel of the motorboat 12 to slow or stop the motorboat 12. As described in greater detail below, the reversing bucket 60 may also be configured to partially obstruct the outlet 256 of the steering nozzle 48 when placed in a neutral position to allow some normal axial water flow below the reversing bucket 60 while reversing some water flow to oppose the normal axial water flow resulting in a net zero thrust allowing the motorboat 12 to sit stationary, and/or to avoid obstructing the outlet 256 of the steering nozzle 48 when placed in an up position, such as during normal forward operation. To this end, the reversing bucket 60 is movably coupled to the jet nozzle 46 via the pair of linkages 62. Each linkage 62 includes a reversing bucket arm 270 fixedly coupled to the reversing bucket 60, such as via fasteners 272, and a jet nozzle arm 274 fixedly coupled to the jet nozzle 46, such as via fasteners 276. As best shown in FIG. 3A, each reversing bucket arm 270 is pivotably coupled to the corresponding jet nozzle arm 274, such as via one or more fasteners 278 and/or bushings 280, to define a reversing axis R about which the reversing bucket 60 may rotate. In this regard, the illustrated reversing bucket 60 includes at least one bucket actuator flange 282 for operatively coupling the reversing bucket 60 to an electro-mechanical actuator 284 (FIG. 2) for controlling the rotation of the reversing bucket 60 relative to the reversing axis R. The illustrated electro-mechanical actuator 284 includes a hollow sleeve 286, a rod 288 positioned within the hollow sleeve 286, and an electric motor 290 pivotably coupled to the impeller housing 42, such as via an actuator bracket 292 coupled to the second mounting flange 112 of the impeller housing 42 and one or more fasteners 294 and/or bushings (not shown), and configured to selectively extend the rod 288 from and retract the rod 288 into the hollow sleeve 286. As shown in FIGS. 6A-6C, retracting the rod 288 into the hollow sleeve 286 via the electric motor 290 may cause the reversing bucket 60 to rotate about the reversing axis R toward the up position, while extending the rod 288 from the hollow sleeve 286 may cause the reversing bucket 60 to rotate about the reversing axis R toward the down position. In one embodiment, the electric motor 290 may be in operative communication with a control system (not shown) of the motorboat 12, which may be configured to send one or more signals to the electric motor 290 for controlling the extension and/or retraction of the rod 288. In the embodiment shown, the electro-mechanical actuator 284, including the electric motor 290, is positioned external to the hull 14 of the motorboat 12. By positioning the electro-mechanical actuator 284 external to the hull 14, it will be appreciated that the number of holes needed in the hull 14 may be reduced as compared to conventional jet pump designs.

Operation of the reversing bucket 60 via the electro-mechanical actuator 284 is illustrated in FIGS. 6A-6C. During normal operation for achieving generally forward motion of the motorboat 12, the rod 288 may be fully retracted into the hollow sleeve 286 such that the reversing bucket 60 is fully raised to the up position in order to avoid obstructing the water flow path exiting the outlet 256 of the steering nozzle 48 (FIG. 6A). The electric motor 290 may partially extend the rod 288 from the hollow sleeve 286, as indicated by the arrow A3, thereby causing the reversing bucket 60 to rotate about the reversing axis R toward the down position, as indicated by the arrow A4, to a neutral position in order to partially obstruct the water flow path exiting the outlet 256, such as for slowing and/or halting forward motion of the motorboat 12 (FIG. 6B). For example, the neutral position may be defined by a half-stroke of the rod 288 from the hollow sleeve 286. The electric motor 290 may further extend the rod 288 from the hollow sleeve 286, thereby causing the reversing bucket 60 to rotate about the reversing axis R to the down position in order to fully obstruct the water flow path exiting the outlet 256 for achieving generally reverse motion of the motorboat 12 (FIG. 6C). For example, the down position may be defined by a full-stroke of the rod 288 from the hollow sleeve 286. The reversing bucket 60 may be returned to the neutral or up positions via operation of the electric motor 290 to retract the rod 288 partially or fully into the hollow sleeve 286, respectively.

Accordingly, the propulsion system 30 of the jet pump 10 may be capable of providing forward, reverse, straight, and/or vectored propulsion of the motorboat 12. The reversing bucket 60 allows for yawing of the motorboat 12 left or right while in forward (up), neutral (partial down), and/or reverse (down) positions. This may allow the motorboat 12 to pivot about a central point thereof without translating forward or aft.

With reference now to FIGS. 2, 2B, 2C, 3, 3C, and 3D the integrated exhaust system 32 of the jet pump 10 includes a generally banjo-shaped engine exhaust adapter or "exhaust banjo" 300, an exhaust conduit 302, and a pair of exhaust ducts 304, which together are configured to direct exhaust from the engine 5 to an exterior of the motorboat 12. The exhaust banjo 300 is rotatable relative to the exhaust conduit 302, which is fixedly coupled to the mounting plate 98 of the water intake 40. See FIG. 7A. The exhaust ducts 304 are also fixedly coupled to the mounting plate 98 of the water intake 40 on a side opposite the exhaust conduit 302. As best shown in FIG. 2, the exhaust banjo 300 is positioned internal to the hull 14 of the motorboat 12 while the exhaust ducts 304 are positioned external to the hull 14 of the motorboat 12 and the exhaust conduit 302 extends through the hull 14 of the motorboat 12.

As shown in FIG. 2C, the exhaust banjo 300, exhaust conduit 302, and exhaust ducts 304 are each at least partially hollow so as to collectively define an exhaust flow path, as indicated by the arrows A5. In this regard, the exhaust banjo 300 includes a stem 310 having at least one inlet 312 (FIGS. 2B and 2C) and a head 314 having first and second axial openings 316, 318 extending through first and second sides 320, 322 of the head 314, respectively. Together, the stem 310 and head 314 define a banjo passageway 324 including an annular chamber 326 and extending between the inlet 312 and at least one outlet 328 provided at or near the second opening 318. The inlet 312 is configured to communicate with an exhaust pipe 330 (FIG. 2C) of the engine 5 for receiving exhaust from the engine 5. In this regard, the exhaust banjo 300 may be rotated about the jet pump longitudinal axis L to a desired orientation to locate the inlet 312 at a suitable position for coupling to the exhaust pipe 330, and/or to accommodate various configurations of the motorboat 12 and/or hull 14. For example, when used in a twin-engine watercraft (not shown), each jet pump 10 may be oriented at an angle relative to horizontal on each side of a centerline of the V-shaped hull of such a watercraft, while the corresponding engines may be level relative to horizontal. In other words, the portside jet pump 10 may be rolled port side up, the starboard-side jet pump 10 may be rolled starboard side up, and both engines may be level. In such a watercraft, the rotatability of the exhaust banjo(s) 300 may eliminate the need for specially configured portside and starboard-side exhaust pipes 330. In addition, or alternatively, the stem 310 may have more than one inlet 312. For example, the stem 310 may be generally Y-shaped to define two inlets 312, such as for coupling the banjo 300 to a V8 engine so that each cylinder bank may feed into a dedicated inlet 312. In any event, the banjo passageway 324 is configured to direct the exhaust received from the engine exhaust pipe 330 generally perpendicularly to the jet pump longitudinal axis L into the annular chamber 326 for evenly distributing exhaust thereabout and redirecting such exhaust generally parallel to the jet pump longitudinal axis L through the at least one outlet 328 of the exhaust banjo 300 into the exhaust conduit 302, as best shown in FIG. 2C.

As shown in FIG. 3D, the illustrated exhaust conduit 302 includes an outer shell portion 332 including a base 334 and a generally cylindrical body 336 extending axially away from the base 334, and a central portion 338 extending between first (upstream) and second (downstream) ends 340, 342. The outer shell portion 332 and central portion 338 are spaced apart from each other by a pair of support flanges 344 to define a pair of conduit passageways 346 including respective semi-annular chambers 348 and extending between respective inlets 350 and outlets 352. A plurality of baffles 354 extend between the central portion 338 and the outer shell portion 332 at or near the inlets 350 for assisting in even distribution of the exhaust received by the conduit passageways 346 from the banjo passageway 324. In the embodiment shown, the support flanges 344 are provided as extensions of two of the baffles 354 and extend along the lengths of the conduit passageways 346 in order to bifurcate the conduit passageways 346, such that a first portion of exhaust received by one of the inlets 350 is directed to the corresponding outlet 352 and a second portion of exhaust received by the other of the inlets 350 is directed to the other corresponding outlet 352.

As best shown in FIGS. 3C and 3D, the central portion 338 of exhaust conduit 302 includes a bore 360 extending along the longitudinal axis L of the jet pump 10 for accommodating a portion of the primary shaft 120. In this regard, a pair of ball bearings 362 are positioned within the bore 360 for rotatably supporting the primary shaft 120 along its length. Each ball bearing 362 includes an inner race 364, an outer race 366, and a plurality of bearing balls 368. The illustrated primary shaft 120 includes first and second shoulders 370, 372 for assisting in retaining the inner races 364 of the ball bearings 362 relative to the primary shaft 120 and the bore 360 includes a shoulder 374 for assisting in retaining the outer races 366 of the ball bearings 362 relative to the central portion 338 of exhaust conduit 302. Thus, the inner races 364 of the ball bearings 362 are rotatable together with the primary shaft 120 while the outer races 366 are fixed relative to the exhaust conduit 302. In the embodiment shown, the outer races 366 of the ball bearings 362 are spaced apart from each other by a bearing collar 376. One or more seals 378 are positioned between the primary shaft 120 and the central portion 338 of the exhaust conduit 302 to prevent water or contaminants from passing therebetween. As shown, the seal 378 is positioned against the shoulder 374 of the bore 360 on a first side of the bearings 362 and a retaining ring 380 is positioned in a circumferential groove 382 of the bore 360 on a second side of the bearings 362 in order to sandwich the outer races 366 of the bearings 362 therebetween, and a spacer 384 is positioned between the seal 378 and the outer race 366 of the adjacent bearing 362. The illustrated exhaust conduit 302 includes a grease fitting 386 (FIG. 2) positioned on the base 334 of the outer shell portion 332 generally above the bearings 362 and/or bearing collar 376 for supplying grease to the bearings 362 via a passage (not shown), for example. The bearing collar 376 may include one or more apertures 388 for facilitating such access to the bearings 362. For example, the one or more apertures 388 may allow grease to flow from the grease fitting 386, through the passage and into the bore 360 and around the bearing collar 376, from which the grease may pass through the apertures 388 to the primary shaft 120 and move axially along the primary shaft 120 to each of the bearings 362.

As shown in FIG. 3D, the cylindrical body 336 of the outer shell portion 332 and the central portion 338 of exhaust conduit 302 are each generally coaxial with the primary shaft 120, such that each of the conduit passageways 346 extend at least partially along, e.g., parallel to, the primary shaft 120 within the exhaust conduit 302.

In the embodiment shown in FIGS. 2B and 3D, the cylindrical body 336 of the outer shell portion 332 of exhaust conduit 302 defines a first bearing surface 390 along which the second opening 318 of the exhaust banjo 300 may rotatably slide. A pair of O-rings 392 are positioned between the outer shell portion 332 and the exhaust banjo 300 to provide a fluid-tight seal therebetween. As shown, the central portion 338 of exhaust conduit 302 extends through the head 314 of the exhaust banjo 300 to at least partially define the annular chamber 326 thereof. The first end 340 of the central portion 338 is coupled to an end cap 400 of the jet pump 10, such as via fasteners 402, which provides a second bearing surface 404 along which the first opening 316 of the exhaust banjo 300 may rotatably slide. The end cap 400 may close off the first opening 316 to prevent exhaust from escaping therethrough. In this regard, a pair of O-rings 406 are positioned between the central portion 338 and the end cap 400 to provide a fluid-tight seal therebetween, and a further pair of O-rings 408 are positioned between the end cap 400 and the exhaust banjo 300 to provide a fluid-tight seal therebetween. Axial movement of the banjo 300 may be limited, such as via operative engagement of the first and/or second side 320, 322 of the head 314 with the engine 5 and/or other components of the jet pump 10 or motorboat 12 in order to rotatably sandwich the banjo 300 in place along the longitudinal axis L, as described in greater detail below. In the embodiment shown, a vibration isolator 410 is positioned on the banjo 300 for inhibiting the transmission of vibrations between the jet pump 10 and the engine 5. As shown in FIG. 3D, a relatively wide flexible band 412 is positioned over the end cap 400 and is configured for clamping into a bellhousing of the engine 5 for locating the engine 5 and the jet pump 10 together. The first and second openings 316, 318 of the banjo 300 are sized to receive at least a portion of the end cap 400 and accompanying flexible band 412 such that the banjo 300 may be slipped over the end cap 400 and onto the cylindrical body 336 and O-rings 392 of the exhaust conduit 302.

As shown, the second end 342 of the central portion 338 is received by the conduit port 96 of the water intake 40. A pair of O-rings 414 are positioned between the central portion 338 and the water intake 40 to provide a fluid-tight seal therebetween. The face seal assembly 140 includes a seal 416 positioned between the primary shaft 120 and the shaft tube 134 to prevent water flow or contaminants from entering the bore 360 of the central portion 338 from the water intake 40. In the embodiment shown, the face seal assembly 140 also includes a flexible holder 417 and a spacer 418 positioned between the seal 416 and the flange 136 of the shaft tube 134. As shown, the face seal assembly 140 further includes a spring 420, spring holder 422, and spacer 424 positioned between the seal 416 and the inner race 364 of the adjacent ball bearing 362 of the exhaust conduit 302 for urging the seal 416 into operative engagement with the shaft tube 134, such as via the spacer 418 and flexible holder 417.

The illustrated exhaust ducts 304 each include a duct passageway 430 extending between an inlet 432 and an outlet 434. As shown in FIG. 3D, each inlet 432 communicates with a corresponding outlet 352 of the exhaust conduit 302 for receiving exhaust therefrom. In this regard, the inlets 432 may each extend at least partially through the corresponding apertures 100 provided in the mounting plate 98 of the water intake 40. In the embodiment shown, the duct passageways 430 are configured to direct the exhaust in a rearward direction generally along and/or adjacent the longitudinal axis L of the jet pump 10 and out of the exhaust system 32. One or more flexible covers or flaps 436 (FIG. 2) may be movably coupled to each exhaust duct 304, such as via fasteners 438, at or near the respective outlet 434 in order to close off the duct passageways 430 when exhaust is not present therein to inhibit backflow of water or contaminants into the duct passageways 430. Such flaps 436 may each be configured to flex to an open position under the pressure of exhaust present in the respective duct passageways 430 in order to allow the exhaust to exit via the corresponding outlet 434. In one embodiment, the flaps 436 may be omitted. In the embodiment shown, the exhaust ducts 304 are fixedly coupled to the mounting flange 88 of the water intake 40, such as via fasteners 440, to assist in providing stability to the exhaust ducts 304.

Thus, the exhaust system 32 is integrated with the propulsion system 30 to provide a compact configuration for simplifying installation as compared to conventional jet pumps. For example, it will be appreciated that only a single jet pump hole 450 (FIG. 7A) may be needed in the hull 14 to accommodate both the primary shaft 120 for transferring torque from the engine 5 to the impeller 114 and the exhaust flow path defined by the various passageways 324, 346, 430 of the exhaust system 32 for transferring exhaust from the engine 5 to an exterior of the hull 14.

Referring now to FIGS. 7 and 7A, the exemplary jet pump 10 is shown mounted to the hull 14 of the motorboat 12 with a substantial portion of the jet pump 10 positioned external to the hull 14. More particularly, the hull 14 includes the pump box 24 having first and second cavities 462, 464 provided on an exterior side of the hull 14 for accommodating at least a portion of the jet pump 10. In the embodiment shown, the pump box 24 is integrally formed with the remaining portions of the hull 14. Other hull configurations may include any other suitable means of accommodating the jet pump 10.

In the embodiment shown, the jet pump 10 is mounted to an exterior bottom surface 466 of the hull 14. In this regard, the base 70 of the water intake 40 is fixedly coupled to an intake mount 470 which is, in turn, fixedly coupled to the exterior bottom surface 466 of the hull 14, such as via fasteners 472. More particularly, the intake mount 470 is generally U-shaped and has first and second ends 474, 476 so as to define a space 478 for receiving the base 70 of the water intake 40. As shown in FIG. 7A, a channel 480 having a generally C-shaped cross section is provided along an inner periphery of the intake mount 470 for mating with the lip 72 of the base 70. The lip 72 and channel 480 may be sized and configured such that, when the lip 72 and channel 480 mate with each other, the intake grate 84 is substantially flush with a bottom side of the intake mount 470. In the embodiment shown, a generally U-shaped vibration isolator 482 having a general C-shaped cross section is positioned between the lip 72 of the base 70 and the channel 480 of the intake mount 470 for inhibiting the transmission of vibrations between the jet pump 10 and the intake mount 470 and, subsequently, inhibiting the transmission of vibrations between the jet pump 10 and the hull 14 of the motorboat 12. In one embodiment, the vibration isolator 482 is constructed of rubber. While the vibration isolator 482 is illustrated as a separate piece, the vibration isolator 482 may be provided in any suitable form. For example, the vibration isolator 482 may be permanently bonded to the channel 480 of the intake mount 470, such as via over-molding. In addition to inhibiting vibration transmission, the vibration isolator 482 may assist in adhering the base 70 of the water intake 40 to the intake mount 470.

In the embodiment shown, a generally U-shaped flange 484 is provided along an outer periphery of the intake mount 470 and a corresponding generally U-shaped recess 486 is provided in the bottom surface 466 of the hull 14 for receiving the generally U-shaped flange 484 of the intake mount 470. In one embodiment, the flange 484 may have a thickness substantially equal to a depth of the generally U-shaped recess 486, such that, when the generally U-shaped recess 486 receives the flange 484 of the intake mount 470, the intake mount 470 is substantially flush with the bottom surface 466. In this manner, the intake mount 470, intake grate 84, and bottom surface 466 of the hull 14 may provide a smooth-running surface for the motorboat 12.

As best shown in FIGS. 7 and 7A, a retention plate 490 is fixedly coupled to the first and second ends 474, 476 of the intake mount 470, such as via fasteners 492, in abutment with a free end of the base 70 to trap the lip 72 of the base 70 of the water intake 40 in the channel 480 of the intake mount 470 and thereby prevent the water intake 40 from sliding free from the intake mount 470. In the embodiment shown, the flange 484 of the intake mount 470 is angled upwardly relative to a centerline of the intake mount 470 in order to follow the shape of the hull 14. It will be appreciated that the intake mount 470 may be configured in any other suitable manner for any other configuration of the hull 14.

Figure 8A:
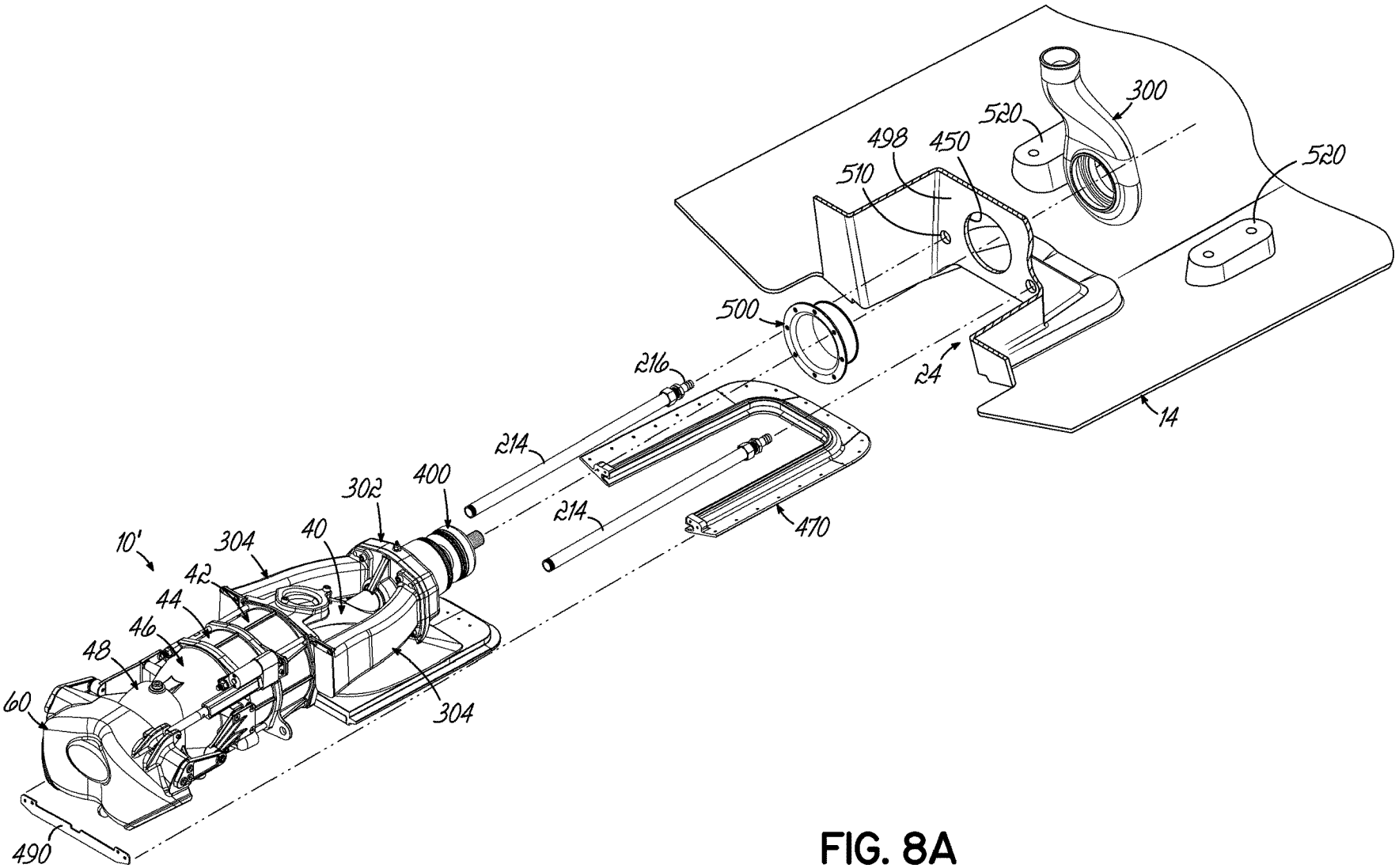
FIGS. 8A-8F illustrate a method of assembling the jet pump shown in FIG. 1 to the hull of the motorboat.

As described above, the exhaust conduit 302 is configured to extend through the hull 14 of the motorboat 12. More particularly, the generally cylindrical body 336 of the outer shell portion 332 of the exhaust conduit 302 is configured to extend through the jet pump hole 450 provided in a stern wall 498 of the hull 14 which at least partially defines the pump box 24. As best shown in FIGS. 2B and 8A, a generally cylindrical seal 500 is positioned over the cylindrical body 336 of the outer shell portion 332 to provide a fluid-tight seal and/or vibration isolation between the cylindrical body 336 and the hull 14. The seal 500 may be constructed of rubber, for example. In the embodiment shown, the seal 500 includes a mounting flange 502 extending about its periphery for fixedly attaching the seal 500 to the stern wall 498 around the jet pump hole 450, such as via fasteners 504. A support ring 506 may be fixedly coupled to the mounting flange 502 to assist in stabilizing the seal 500. In one embodiment, the support ring 506 may be constructed of metal and may be permanently coupled to the mounting flange 502, such as via over-molding. As shown, one or more worm drive clamps 508 may be positioned over the cylindrical seal 500 and tightened thereabout to firmly clamp the seal 500 against the cylindrical body 336 of the exhaust conduit 302. In this manner, the cylindrical seal 500 may also assist in stabilizing the exhaust conduit 302 within the jet pump hole 450.

In one embodiment, the jet pump hole 450 may be vertically spaced from the channel 480 of the intake mount 470 by a first distance and the cylindrical body 336 of the exhaust conduit 302 may be vertically spaced from the lip 72 of the base 70 by a second distance substantially equal to the first distance, such that the jet pump 10 may readily fit in the pump box 24 with the cylindrical body 336 received by the jet pump hole 450 and the lip 72 received by the channel 480. For example, inserting the lip 72 into the channel 480 may cause the cylindrical body 336 to automatically self-align with the jet pump hole 450.

Various components of the jet pump 10 may be constructed of plastic and/or metal. For example, certain components of the jet pump 10 may be constructed of cast aluminum. It will be appreciated that the components of the jet pump 10 may be constructed of any suitable material.

Referring now to FIGS. 8A-8F, a method of installing the jet pump 10 onto the hull 14 of the motorboat 12 is provided. Initially, the jet pump hole 450 is provided in the stern wall 498 of the hull 14, such as via a drilling operation, for receiving at least a portion of the jet pump 10 (FIG. 8A). In the embodiment shown, a pair of water pipe holes 510 are also provided in the stern wall 498, such as via a drilling operation, for receiving portions of the water pipes 214. As described above, only one of the water pipes 214 may be needed such that one of the water pipe holes 510 may be eliminated, or both water pipe holes 510 may be eliminated. While not shown, one or more additional holes may be provided in the hull 14, such as in the stern wall 498, for receiving a steering cable associated with the steering nozzle 48 and/or a wiring harness associated with the electromechanical actuator 284 of the reversing bucket 60, for example. In any event, the total quantity of holes provided in the hull 14 for operation of the motorboat 12 may be minimized thereby reducing installation time and/or risk of leakages as compared to conventional installation techniques.

As shown, the jet pump 10 may initially be separated into a jet pump assembly portion 10' including, for example, the water intake 40, the impeller housing 42, the stator 44, the jet nozzle 46, the steering nozzle 48, the reverse bucket 60, the exhaust conduit 302, the exhaust ducts 304, and the end cap 400, positioned external to the hull 14 and the exhaust banjo 300 positioned internal to the hull 14. The cylindrical seal 500 may be separated from the jet pump assembly portion 10' and axially aligned with the jet pump hole 450 external to the hull 14, while the water pipes 214 and accompanying water pipe fittings 216 may also each be separated from the jet pump assembly portion 10' and axially aligned with the corresponding water pipe holes 510 external to the hull 14.

Figure 8B:
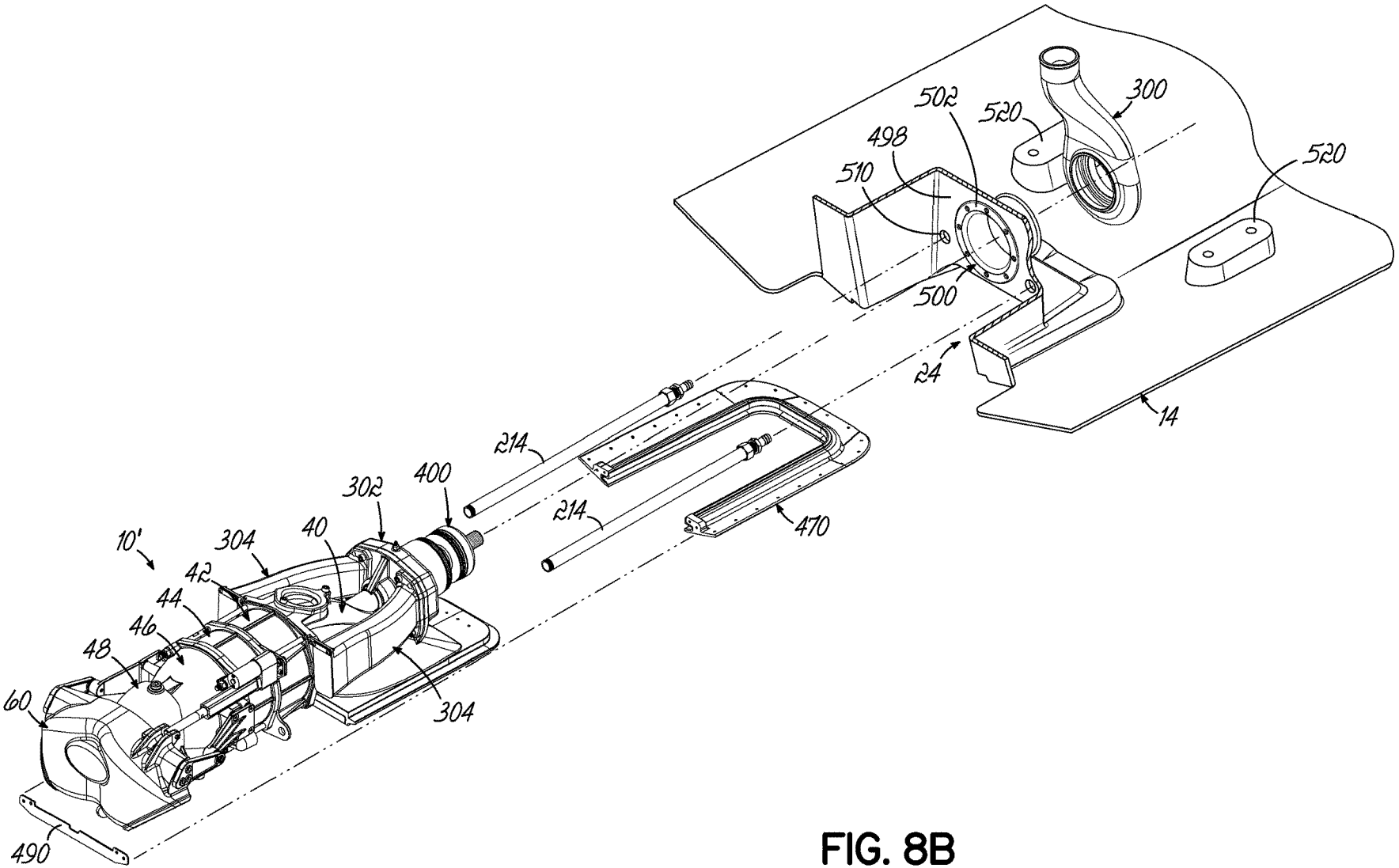
Figure 8C:
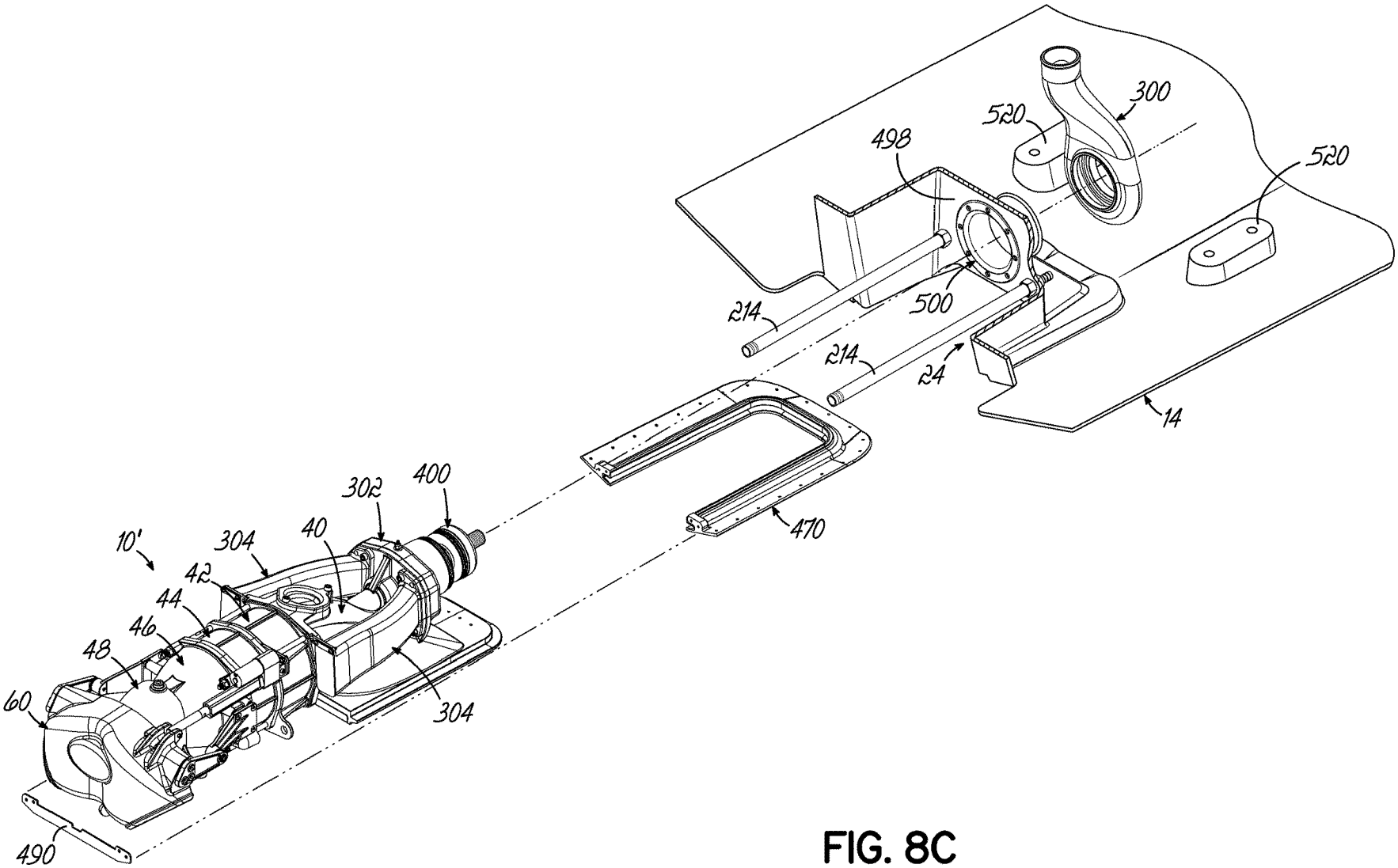

With the cylindrical seal 500 axially aligned with the jet pump hole 450, the cylindrical seal 500 is inserted into the jet pump hole 450 (FIG. 8B). As shown, the mounting flange 502 of the seal 500 may abut the stern wall 498 around the jet pump hole 450 when the cylindrical seal 500 is fully inserted. The seal 500 is then fixedly coupled to the stern wall 498 of the hull 14, such as via fasteners 504 (not shown in FIG. 8B) to secure the seal 500 in place. With one or both of the water pipe fittings 216 axially aligned with one or both of the water pipe holes 510, the water pipe fitting(s) 216 may be installed into the corresponding water pipe hole(s) 510 with sealing washers and nuts (not shown in FIG. 8B). With one or both of the water pipes 214 axially aligned with one or both of the water pipe holes 510, the water pipe(s) 214 may be coupled to the corresponding water pipe fittings 216 (FIG. 8C).

Figure 8D:
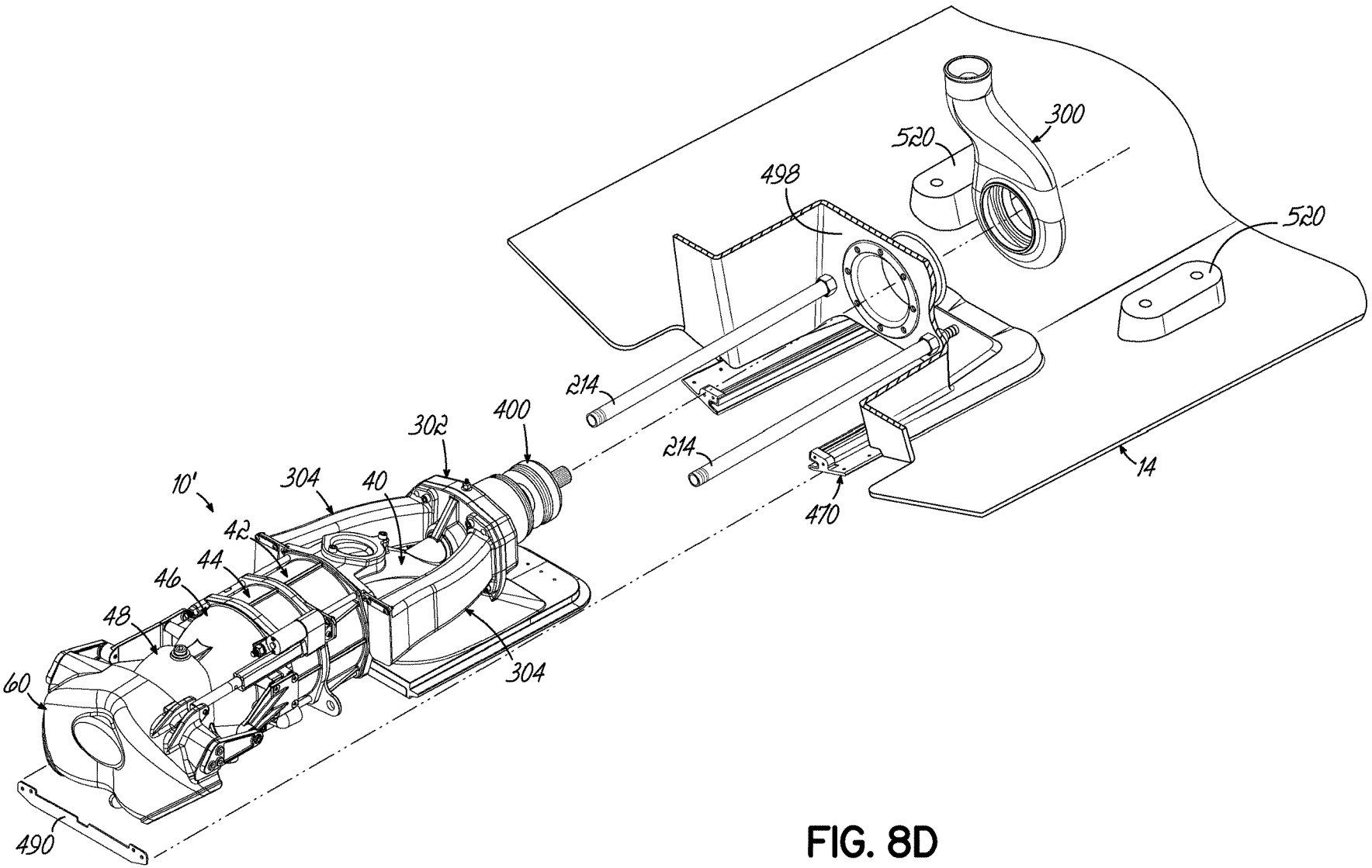

In the embodiment shown, the intake mount 470 is then fixedly coupled to the exterior bottom surface 466 of the hull 14 (FIG. 8D). More particularly, the flange 484 of the intake mount 470 is positioned in the recess 486 of the bottom surface 466 and fixedly coupled thereto, such as via fasteners 472 (not shown in FIG. 8D). With the cylindrical seal 500 and intake mount 470 each fixedly coupled to the hull 14, the jet pump assembly portion 10' of the jet pump 10 may be positioned external to the hull 14 such that the jet pump longitudinal axis L is aligned with the jet pump hole 450.

Figure 8E:
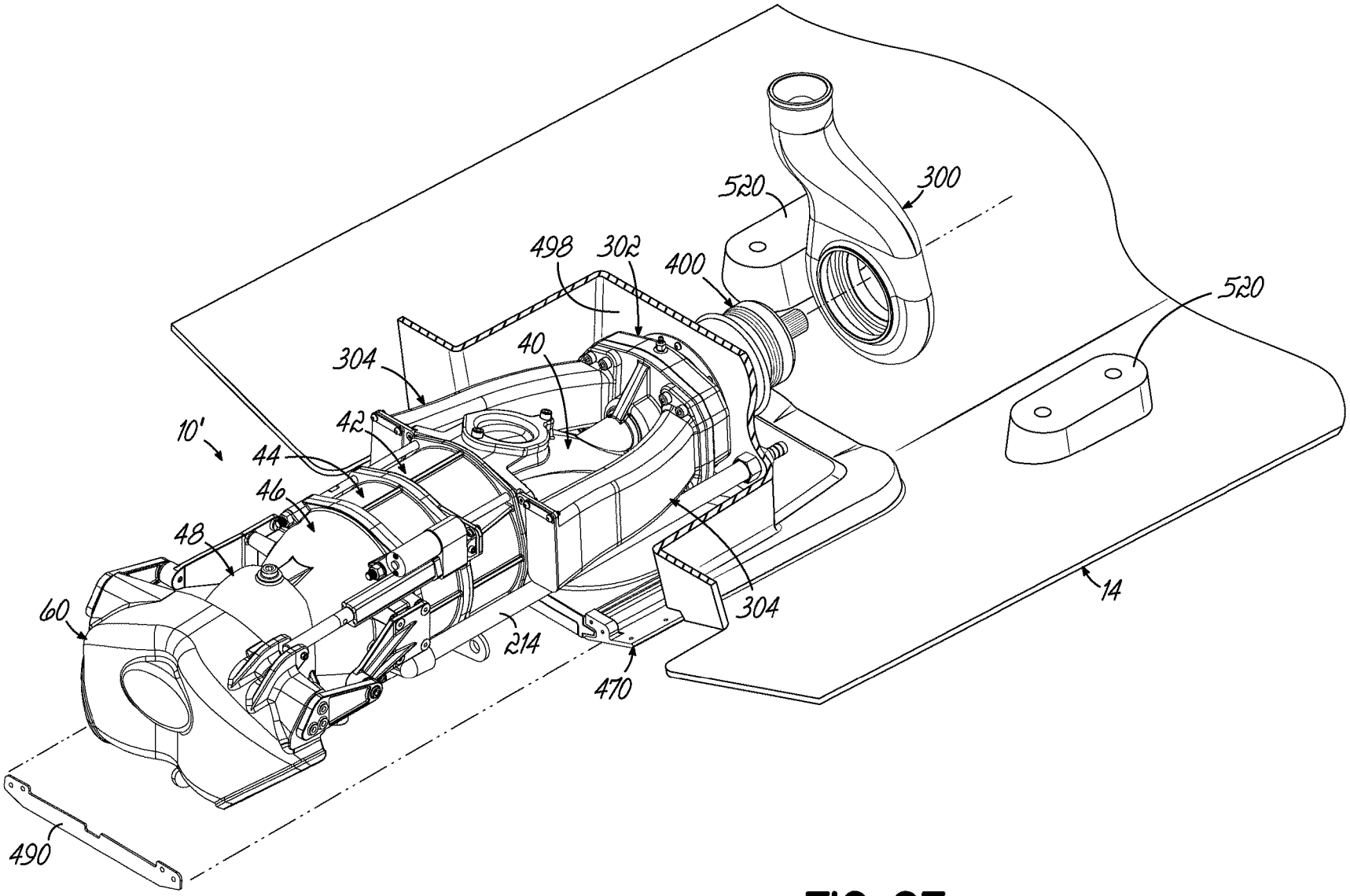

With the jet pump longitudinal axis L aligned with the jet pump hole 450, the jet pump assembly portion 10' of the jet pump 10 is advanced toward the stern wall 498 of the hull 14 such that the lip 72 of the intake base 70 is received by the channel 480 and/or vibration isolator 482 of the intake mount 470 and such that the cylindrical body 336 of the exhaust conduit 302 is received by the cylindrical seal 500 so as to extend through the stern wall 498 (FIG. 8E). As described above, insertion of the lip 72 into the channel 480 may assist in alignment of the cylindrical body 336 with the cylindrical seal 500. The cylindrical seal 500 may be clamped to the cylindrical body 336 of the exhaust conduit 302, such as via worm drive clamps 508 (not shown in FIG. 8E). The one or more water pipes 214 may be fluidly coupled to the corresponding water outlets 212 of the jet nozzle 46. With the lip 72 of the intake base 70 received by the channel 480 and/or vibration isolator 482 of the intake mount 470, the retention plate 490 may be aligned with the intake mount 470. Likewise, with cylindrical body 336 of the exhaust conduit 302 extending through the stern wall 498, the exhaust banjo 300 may be positioned internal to the hull 14 such that the first and second openings 316, 318 are aligned with the jet pump longitudinal axis L.

Figure 8F:
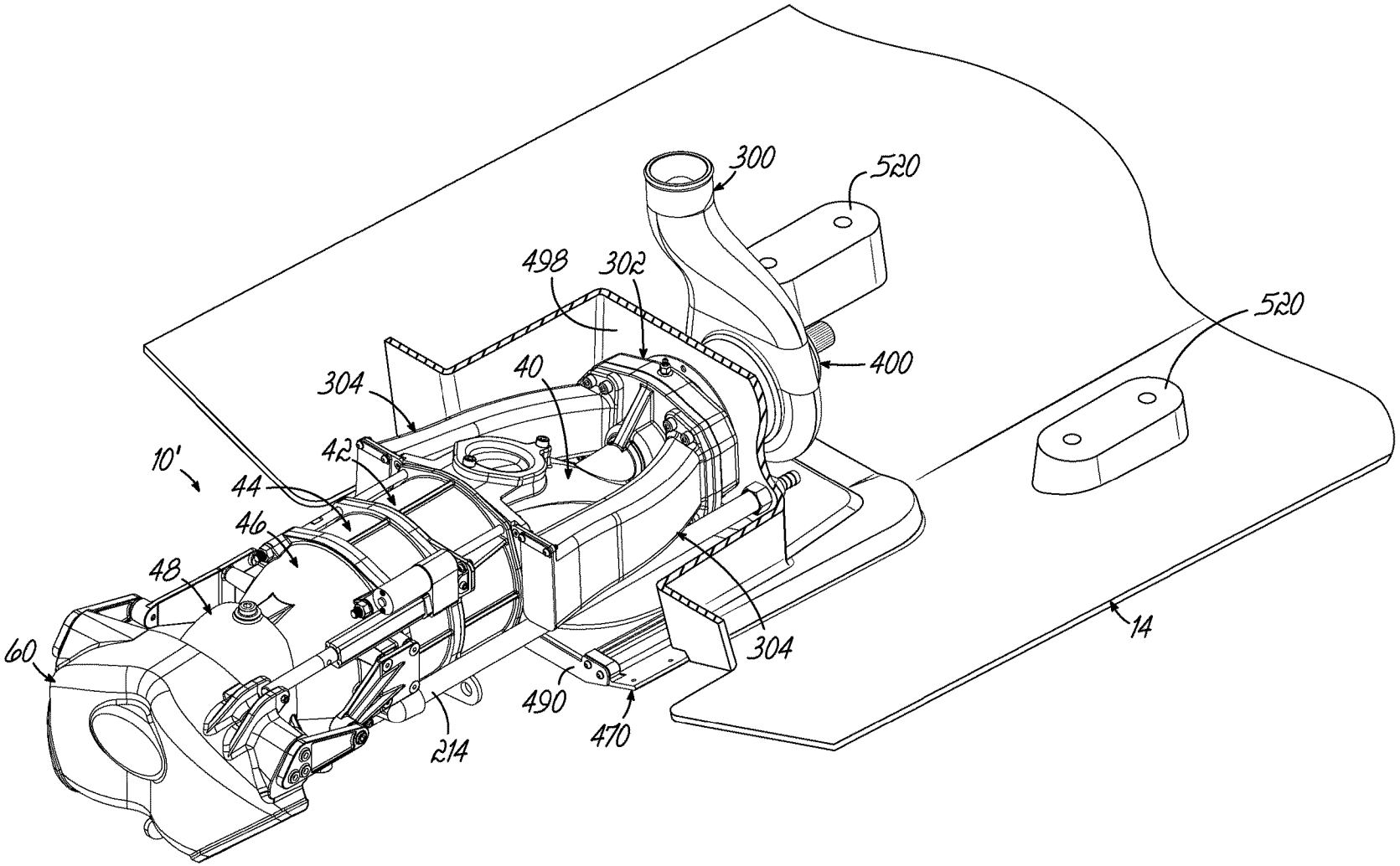

In the embodiment shown, the retention plate 490 is then fixedly coupled to the intake mount 470, such as via fasteners 492, in order to retain the jet pump 10 in place, and the exhaust banjo 300 is rotatably positioned over the central portion 338 of the exhaust conduit 302, such as by slipping the banjo 300 over the end cap 400 and onto the cylindrical body 336 and O-rings 392 of the exhaust conduit 302, to complete assembly of the jet pump 10 (FIG. 8F). While not shown, the engine 5 may then be installed in the interior of the hull 14, such as via engine mounting points 520, and the engine 5 and jet pump 10 may be located relative to each other via interaction of the flexible band 412 of the end cap 400 with the bellhousing of the engine 5 so that the input end 122 of the primary shaft 120 may be operatively coupled to an output shaft of the engine 5. In one embodiment, a portion of the engine 5 may operatively engage the first side 320 of the exhaust banjo 300 in order to rotatably sandwich the exhaust banjo 300 between the portion of the engine 5 and the cylindrical seal 500 and/or cylindrical body 336 of the exhaust conduit 302, for example. In this manner, the exhaust banjo 300 may be rotated to position the inlet 312 in a suitable location for coupling to at least one exhaust pipe 330 of the engine 5.

Accordingly, complete installation of the jet pump 10 may be accomplished in a relatively short time period as compared to conventional installation techniques. Moreover, by installing the jet pump 10 with a substantial portion of the jet pump 10 external to the hull 14, a single jet pump hole 450 may extend through the hull 14 thereby decreasing alignment issues and opportunities for leakages to occur. No additional drilling may be required to route exhaust away from the engine 5 to an exterior of the motorboat 12.

Figure 9:
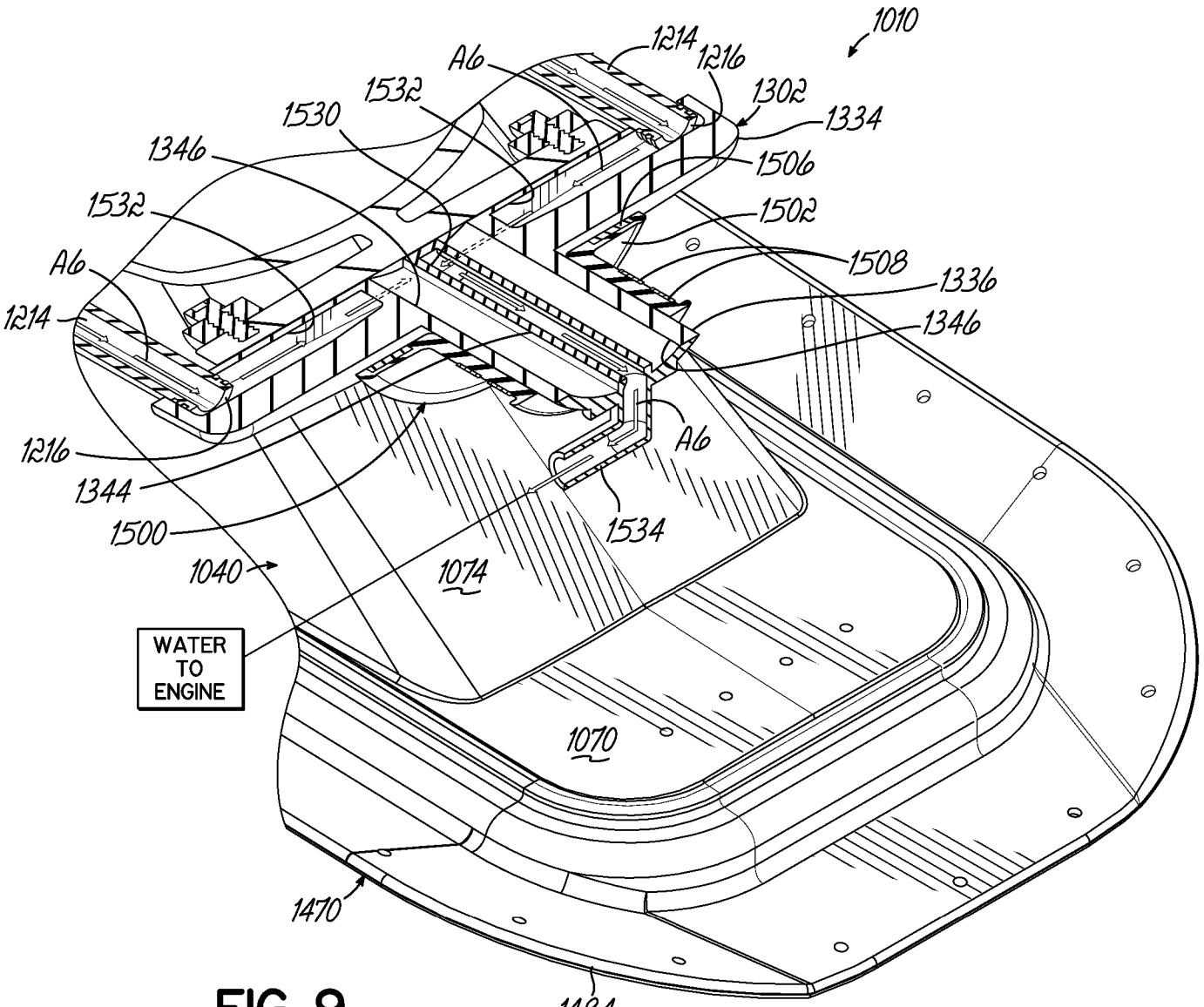
FIG. 9 is a partial perspective view of another exemplary jet pump in accordance with another aspect of the invention.

Referring now to FIG. 9, wherein similar reference numerals in the 1000 series represent features similar to those described above, an exemplary jet pump 1010 according to another aspect of the invention is shown. In addition to a pair of conduit passageways 1346 for receiving exhaust from the exhaust banjo (not shown in FIG. 9), the exhaust conduit 1302 includes a central cooling water passageway 1530 extending generally between and parallel to the conduit passageways 1346 within the cylindrical body 1336 of the exhaust conduit 1302. In the embodiment shown, the central cooling water passageway 1530 extends through a thickened support flange 1344 of the exhaust conduit 1302. A pair of tributary cooling water passageways 1532 are provided in the base 1334 of the exhaust conduit 1302 in communication with the central cooling water passageway 1530 and are configured to communicate with the water pipes 1214 via water pipe fittings 1216. An engine water fitting 1534 is coupled to the cylindrical body 1336 of the exhaust conduit 1302 at or near a downstream end of the central cooling water passageway 1530 for directing water received from the central cooling water passageway 1530 to the engine 5. In this manner, water may flow from the water outlets of the jet nozzle (not shown in FIG. 9), through the water pipes 1214, into the tributary cooling water passageways 1532 of the exhaust conduit 1302, through the central cooling water passageway 1530, and to a cooling system heat exchanger of the engine 5 for cooling purposes, as indicated by the arrows A6. While two water pipes 1214, water pipe fittings 1216, and tributary cooling water passageways 1532 are shown, it will be appreciated that only a single water pipe 214, water pipe fitting 216, and tributary cooling water passageway 1532 may be used to supply water to the engine 5 such that the other water pipe 214, water pipe fitting 216, and tributary cooling water passageway 1532 may be eliminated. By integrating the central cooling water passageway 1530 into the exhaust conduit 1302, the cooling water flow path may extend through the same jet pump hole 450 as the primary shaft and the exhaust flow path (not shown in FIG. 9), thereby obviating the need for any dedicated water pipe holes 510 through the stern wall 498 such that the water pipe holes 510 may be eliminated. In this manner, the number of holes required in the hull 14 of the boat 12 may be further reduced.

The illustrated jet pump 1010 also has a water intake 1040 including a rectangular base 1070 and main a body 1074, an intake mount 1470 including a generally U-shaped flange 1484, and a generally cylindrical seal 1500 including a mounting flange 1502, a support ring 1506, and worm drive clamps 1508, each of which is generally similar to those corresponding components described above.

While the present invention has been illustrated by the description of specific embodiments thereof, and while the embodiments have been described in considerable detail, it is not intended to restrict or in any way limit the scope of the appended claims to such detail. The various features discussed herein may be used alone or in any combination. Additional advantages and modifications will readily appear to those skilled in the art. The invention in its broader aspects is therefore not limited to the specific details, representative apparatus and methods and illustrative examples shown and described. Accordingly, departures may be made from such details without departing from the scope of the general inventive concept.

What is claimed is:

1. A method of installing a jet pump onto a hull of a watercraft, the method comprising:

fixedly coupling a generally U-shaped intake mount to an external surface of the hull;

positioning a jet pump assembly external to the hull, the jet pump assembly including a rotatable shaft for receiving torque from an engine such that the rotatable shaft extends through a jet pump hole provided in the hull; and fixedly coupling a water intake of the jet pump assembly to the generally U-shaped intake mount including positioning a lip of the jet pump assembly within a channel of the generally U-shaped intake mount.

2. The method of claim 1, further comprising inserting a cylindrical seal into the jet pump hole prior to positioning the jet pump assembly.

3. The method of claim 1, further comprising positioning an exhaust banjo internal to the hull, the exhaust banjo including an exhaust path portion, such that the exhaust banjo surrounds at least a portion of the rotatable shaft.

4. The method of claim 3, further comprising rotating the exhaust banjo relative to an axis of the rotatable shaft.

5. The method of claim 3, further comprising coupling the exhaust banjo to at least one exhaust port of the engine.

6. The method of claim 1, further comprising positioning at least one vibration isolator between the generally U-shaped intake mount and the jet pump assembly.

7. The method of claim 1, wherein fixedly coupling the generally U-shaped intake mount to the external surface of the hull includes positioning at least a portion of the generally U-shaped intake mount within a recess of the external surface of the hull.

8. The method of claim 1, wherein the jet pump assembly includes a reversing bucket and an electro-mechanical actuator operatively coupled to the reversing bucket for moving the reversing bucket between at least an up position and a down position, the method further comprising positioning the electro-mechanical actuator external to the hull.

9. The method of claim 1, wherein fixedly coupling the jet pump assembly to the generally U-shaped intake mount further includes fixedly coupling a retention plate to the generally U-shaped intake mount to trap the lip of the jet pump assembly within the channel of the generally U-shaped intake mount.

10. A method of installing a jet pump onto a hull of a watercraft, the hull including a stern wall at least partially defining a pump box having first and second cavities, the stern wall of the hull having a jet pump hole extending therethrough between the pump box and an interior of the hull, the method comprising:

positioning a jet pump assembly at least partially within the pump box such that a water intake of the jet pump assembly is at least partially within one of the first and second cavities and an exhaust conduit of the jet pump assembly is at least partially within the other of the first and second cavities of the pump box, the jet pump assembly including a rotatable shaft for receiving torque from an engine such that the rotatable shaft extends through the jet pump hole; and fixedly coupling the jet pump assembly to the hull.

11. The method of claim 10, further comprising fixedly coupling an intake mount to an external surface of the hull below the pump box, wherein fixedly coupling the jet pump assembly to the hull includes fixedly coupling the jet pump assembly to the intake mount.

12. The method of claim 11, wherein the hull includes an external recess proximate the pump box, and wherein fixedly coupling the intake mount to the external surface of the hull includes positioning at least a portion of the intake mount within the external recess.

13. The method of claim 10, further comprising positioning an exhaust banjo within the interior of the hull on a side of the single jet pump hole opposite the jet pump assembly, the exhaust banjo including an exhaust path portion, such that the exhaust banjo surrounds at least a portion of the rotatable shaft.

14. A method of installing a jet pump onto a hull of a watercraft, the hull including a stern wall having a single jet pump hole extending therethrough, the method comprising:

fixedly coupling a generally U-shaped intake mount to an external surface of the hull;

providing a jet pump assembly including a water intake having a conduit portion configured to receive a rotatable shaft for receiving torque from an engine, the conduit portion being arranged along a longitudinal axis of the jet pump assembly;

aligning the longitudinal axis of the jet pump assembly with the single jet pump hole; and positioning a portion of the water intake of the jet pump assembly within a channel of the generally U-shaped intake mount and securing a retention plate to the generally U-shaped intake mount to secure the water intake of the jet pump assembly to the generally U-shaped intake mount.

15. The method of claim 14, further comprising providing the rotatable shaft within the conduit portion, wherein the rotatable shaft is arranged along the longitudinal axis of the jet pump assembly.

16. The method of claim 15, wherein aligning the longitudinal axis of the jet pump assembly with the single jet pump hole includes extending the rotatable shaft through the single jet pump hole.

17. The method of claim 14, further comprising positioning an exhaust banjo on a side of the single jet pump hole opposite the jet pump assembly, the exhaust banjo including an exhaust path portion, such that the exhaust banjo is aligned with the longitudinal axis of the jet pump assembly.

18. The method of claim 17, further comprising rotating the exhaust banjo about the longitudinal axis of the jet pump assembly.

* * * * *